United States Patent [19]

Yagihara et al.

[11] Patent Number: 4,950,578

[45] Date of Patent: Aug. 21, 1990

[54] SILVER HALIDE PHOTOGRAPHIC MATERIAL

[75] Inventors: Morio Yagihara; Kazunobu Katoh, both of Kanagawa, Japan

[73] Assignee: Fuji Photo Film Co., Ltd., Minami-Ashigara, Japan

[21] Appl. No.: 381,209

[22] Filed: Jul. 18, 1989

[30] Foreign Application Priority Data

Jul. 19, 1988 [JP] Japan ..... 63-179760

[51] Int. Cl.[5] ..... G03C 1/06

[52] U.S. Cl. ..... 430/264; 430/598

[58] Field of Search ..... 430/264, 598

[56] References Cited

U.S. PATENT DOCUMENTS 4,737,442 4/1988 Yagihara et al. ..... 430/264

*Primary Examiner*—Paul R. Michl
*Assistant Examiner*—Janet C. Baxter
*Attorney, Agent, or Firm*—Burns, Doane, Swecker & Mathis

[57] ABSTRACT

A silver halide photographic material is disclosed, comprising a support having thereon at least one of silver halide photographic emulsion layers and other hydrophilic colloid layers, wherein at least one of said silver halide photographic emulsion layers and other hydrophilic colloid layers contains a compound represented by formula (I):

(I)

wherein at least one of $A_1$ and $A_2$ represent a hydrogen atom and the other represents a hydrogen atom, a sulfonyl group or an acyl group; $G_1$ represents a carbonyl group, a sulfonyl group, a sulfoxy group, a group, a group, or an iminomethylene group; $L_1$ represents a bivalent group; $X_1$ represents —O— or an group wherein $R_4$ is hydrogen, an alkyl group or an aryl group; $Y_1$ represents $R_1$ and $R_2$ each represents an aliphatic group, an aromatic group, a heterocyclic group, —$OR_5$ or —$NR_5R_6$ wherein $R_5$ is an aliphatic group, an aromatic group or a heterocyclic group, and $R_6$ is a hydrogen atom, an liphatic group, an aromatic group or a heterocyclic group; and $R_3$ represents a hydrogen atom, an alkyl group, an aryl group, an alkoxy group, an aralkyl group, an aryloxy group, a hydrazino group or an amino group.

17 Claims, No Drawings

SILVER HALIDE PHOTOGRAPHIC MATERIAL

FIELD OF THE INVENTION

The present invention relates to a silver halide photographic material which provides a negative image having extremely high contrast, high sensitivity and excellent halftone quality, and a silver halide photographic material which provides a direct positive photographic image. More particularly, the present invention relates to a photographic light-sensitive material which includes a novel silver halide nucleating agent.

BACKGROUND OF THE INVENTION

U.S. Pat. No. 3,730,727 (developing solutions comprising a combination of ascorbic acid and hydrazine), U.S. Pat. No. 3,227,552 (use of hydrazine as a auxiliary developing agent for providing a direct positive color image), U.S. Pat. No. 3,386,831 (use of $\beta$-monophenylhydrazide of aliphatic carboxylic acid as a stabilizer for silver halide light sensitive materials), U.S. Pat. No.2,419,975, and Mees, The Theory of Photographic Process, 3rd ed., 1966, page 281, disclose the use of hydrazine compounds in a silver halide photographic emulsions or developing solutions.

In particular, it is disclosed in U.S. Pat. No. 2,419,975 that a high contrast negative image can be obtained by the incorporation of a hydrazine compound.

The patent discloses that when a light-sensitive material comprising a silver bromochloride emulsion containing a hydrazine compound incorporated therein is developed with a developing solution having a high pH value such as 12.8, an extremely high contrast having a gamma value of more than 10 can be provided. However, strongly alkaline developing solutions having pH values of near 13 are susceptible to air oxidation and are unstable, they are therefore, unsuitable for prolonged use or storage.

An ultra-high contrast wherein a gamma value is more than 10 is extremely useful for the photographic reproduction of continuous tone images or the reproduction of line images by dot image processing which is useful for photo-engraving making regardless of whether negative images or positive images are formed. For this purpose, a light-sensitive material comprising a silver chloride content of 50 mol % or more and preferably 75 mol % or more, has been developed with a hydroquinone developing solution having an extremely low effective concentration of sulfinic ion (normally 0.1 mol/l or less). However, because of its low sulfinic ion concentration, such a developing solution is extremely unstable and defies prolonged storage (e.g., more than 3 days).

Furthermore, these methods require the use of a silver bromochloride emulsion having a rather high silver chloride content and thus cannot provide high sensitivity. It has, therefore, been desired to obtain ultra-high contrast useful for reproduction of dot images or line images using a high sensitivity emulsion and a stable developing solution.

The Inventors have disclosed a silver halide photographic emulsion which is developed with a stable developing solution to provide an extremely high contrast (see U.S. Pat. Nos. 4,224,401, 4,168,977, 4,243,739, 4,272,614 and 4,323,643). However, it has been found that the acyl hydrazine compounds used in these emulsions have some disadvantages.

For example, the hydrazines have been known to produce nitrogen gas during development. The nitrogen gas forms bubbles in the film which damage photographic images. Furthermore, the nitrogen gas flows into the developing solution, adversely effecting other photographic light-sensitive materials.

Furthermore, these hydrazines are disadvantageous in that they need to be used in large amounts to provide sensitization and higher contrast. These hydrazines are also disadvantageous in that when they are used in combination with other sensitizing technics (e.g., to increase chemical sensitization, increase grain size, sensitization accelerating compounds as described in U.S. Pat. No. 4,272,606, and 4,241,164 may be added) to render the light-sensitive material more sensitive, sensitization and/or fogging may occur during the storage of the light-sensitive material.

Therefore, it would be beneficial to provide a compound which can reduce bubble production and the flow of bubbles into the developing solution, which causes no stability problems with time, and can be used in extremely small amounts to provide high contrast.

U.S. Pat. Nos. 4,385,108, 4,269,929 and 4,243,739 indicate that hydrazines containing substituents which are easily adsorbed by silver halide grains can be used to obtain extremely high contrast negative gradation. Among hydrazine compounds containing such adsorption groups, the specific examples described above are disadvantageous in that they are subject to desensitization with time upon storage.

On the other hand, there are various direct positive photographic processes. Among these processes, the most useful are processes in which silver halide grains are exposed to light in the presence of a desensitizer, and then developed, and processes in which silver halide emulsions containing light-sensitive nuclei primarily within the silver halide grains are exposed to light, and then developed in the presence of a nucleating agent. The present invention relates to the latter type of process. A silver halide emulsion containing light-sensitive nuclei primarily within the silver halide grains which forms latent images therein is commonly referred to as an internal latent image type silver halide emulsion. This type of emulsion is distinguished from silver halide emulsions which form latent images primarily on the surface of silver halide grains.

There are known processes in which internal latent image-type silver halide photographic emulsions are surface-developed in the presence of a nucleating agent to provide direct positive images, as well as photographic emulsions or light-sensitive materials for use in such processes.

In the above described processes for the formation of direct positive images, nucleating agents have been incorporated in the developing solution. Also nucleating agents have been incorporated in the photographic emulsion layer or other proper layers in light-sensitive materials so that when it is absorbed by the surface of silver halide grains, better reversal properties can be obtained.

Examples of such nucleating agents include hydrazines such as those described in U.S. Pat. Nos. 2,563,785 and 2,588,982, hydrazide and hydrazine compounds such as those described in U.S. Pat. No. 3,227,552, heterocyclic quaternary salt compounds such as those described in U.S. Pat. Nos. 3,615,615, 3,719,494, 3,734,738, 4,094,683 and 4,115,122, British Pat. Nos. 1,283,835, and JP-A-Nos. 52-3,426, and 52-69,613 (the term "JP-A" as used herein means an "unexamined published Japanese patent application"), thiourea-bound acylphenylhydrazine compounds such as those described in U.S. Pat. Nos. 4,030,925, 4,031,127, 4,139,387, 4,245,037, 4,255,511 and 4,276,364 and British Pat. No. 2,012,443, compounds containing as adsorption groups heterocyclic thioamide such as those described in U.S. Pat. No. 4,080,207, phenylacylhydrazine compounds containing heterocyclic groups comprising mercapto groups as adsorption groups such as those described in British Pat. No. 2,011,397B, sensitizing dyes containing in the molecular structure thereof substituents having a nucleating effect such as those described in U.S. Pat. No. 3,718,470 and hydrazine compounds such as those described in JP-A Nos. 59-200,230, 59-212,828 and 59-212,829 and Research Disclosure No. 23,510 (Jan. 1953).

However, these compounds for obtaining a negative image and positive image having high contrast have been found disadvantageous in that they provide insufficient activity as nucleating agents. Even when they provide sufficient activity, their preservability has been found to be insufficient. Their activity may be deteriorated by the time when it is coated on a support in the form of an emulsion. If they are used in large amounts, they deteriorate the properties of the prepared film.

For the purpose of solving these problems, there have been proposed nucleating agents disclosed in JP-A-No. 60-179734, JP-A-No. 61-170733, JP-A-No. 61-270744, JP-A-No. 62-65034, JP A-No. 62-948, JP A-No. 63-223744, JP-A-No. 63-234244, JP-A-No. 63-234245, JP-A-No. 63-234246, Japanese Pat. application Nos. 62-166117 and 62-143469. However, it is desired to provide agents having more higher nucleating activity, which meet requirements of lowering the pH of processing solution to enhance the stability of the developing solution (namely, to prevent developing agents from being deteriorated), shortening processing time in development or reducing change of compositions in the developing solutions (e.g., pH, sodium sulfite, etc.).

SUMMARY OF THE INVENTION

Accordingly, the first object of the present invention is to provide a silver halide photographic material which gives photographic characteristics exhibiting super-high-contrast negative gradation and having a gamma value exceeding 10 by using a stable developing solution.

The second object of the present invention is to provide a negative type silver halide photographic material which contains a novel high-activity hydrazine compound capable of giving photographic characteristics exhibiting desired super-high-contrast negative gradation even by using a small amount of a developing solution having a low pH without having an adverse effect on photographic characteristics.

The third object of the present invention is to provide a direct positive silver halide photographic material which contains a novel high-activity hydrazine compound capable of giving excellent reversal characteristics even with a developing solution having a low pH.

The fourth object of the present invention is to provide a silver halide photographic material which has good long-term stability and contains a novel high-activity hydrazine compound excellent in preservability.

The above-described objects of the present invention have been achieved by providing a silver halide photographic material comprising a support having thereon at least one of silver halide photographic emulsion layers and other hydrophilic colloid layers, wherein at least one of said silver halide photographic emulsion layers and other hydrophilic colloid layers contains a compound represented by formula (I)

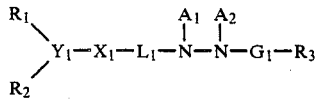

(I)

In the formula (I), $A_1$ and $A_2$ each represents a hydrogen atom or one of $A_1$ and $A_2$ is a hydrogen atom and the other is a sulfonyl group or an acyl group; $G_1$, represents a carbonyl group, sulfonyl group, sulfoxy group, a group of ps

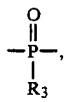

a group of ps

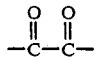

or an iminomethylene group; $L_1$ represents a bivalent group; $X_1$ represents —O— or a group of ps

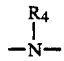

wherein $R_4$ is hydrogen atom, an alkyl group or an aryl group; $Y_1$ represents a group of ps

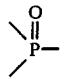

or a group of ps

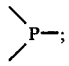

$R_1$ and $R_2$ each

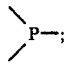

represents an aliphatic group, an aromatic group, a heterocyclic group, a group of $—OR_5$ or a group of $—NR_5R_6$ wherein $R_5$ is an aliphatic group, an aromatic group or a heterocyclic group and $R_6$ is hydrogen atom, an aliphatic group, an aromatic group or a heterocyclic group; and $R_3$ represents a hydrogen atom, an alkyl group, an aryl group, an alkoxy group, an aryloxy group, a hydrazino group or an amino group.

Hydrazine compounds having unexpectedly high activity have been surprisingly found by introducing a group of $—Y_1—X_1—$ into the molecule as shown in the formula (I).

DETAILED DESCRIPTION OF THE INVENTION

The compounds having the formula (I) will be described in more detail below.

In formula (I), examples of atoms or groups represented by $A_1$ and $A_2$ include a hydrogen atom, an alkylsulfonyl group having not more than 20 CarbOn atoms, an arylsulfonyl group (preferably, a phenylsulfonyl group or a substituted phenylsulfonyl group which is substituted to such an extent as to give the sum of Hammett's substituent constants of not less than −0.5), an acyl group having not more than 20 carbon atoms (preferably, a benzoyl group or a substituted benzoyl group which is substituted to such an extent as to give the sum of Hammett's substituent constants of not less than 0.5) or a straight-chain, branched or cyclic, unsubstituted or substituted aliphatic acyl group (examples of substituent groups include a halogen atom, an ether group, a sulfonamido group, a carbonamido group, a hydroxyl group, a carboxyl group or a sulfo group). The compounds where both of $A_1$ and $A_2$ are hydrogen atoms are particularly preferred.

The aliphatic group represented by $R_1$ and $R_2$ includes straight-chain, branched or cyclic alkyl, alkenyl or alkenyl groups. These groups have preferably 1 to 30 carbon atoms, particularly preferably 1 to 20 carbon atoms. The branched alkyl group may be cyclized to form a three-membered to seven-membered saturated heterocyclic ring containing one or more hetero-atoms (e.g., N, O and S).

Examples of the aliphatic group include methyl, t-butyl, n-octyl, t-octyl, cyclohexyl, hexenyl, pyrrolidyl, tetrahydrofuryl and n-dodecyl.

The aromatic group includes monocyclic or bicyclic aryl groups such as phenyl and naphthyl.

The heterocyclic group includes three-membered to ten-membered saturated or unsaturated heterocyclic rings containing at least one hetero-atom of N, O and S. These groups may be monocyclic groups or may be combined together with other aromatic ring or heterocyclic ring to form a condensed ring. Preferred heterocyclic rings are five-membered or six-membered aromatic heterocyclic rings. Examples of the preferred heterocyclic rings include pyridyl, imidazolyl, quinolinyl, benzimidazolyl, pyrimidyl, pyrazolyl, isoquinolinyl, benzthiazolyl and thiazolyl.

Examples of the aliphatic group, the aromatic group and the heterocyclic group represented by $R_5$ and $R_6$ in the groups $OR_5$ and $NR_5R_6$ are those already described above with regard to the definitions of $R_1$ and $R_2$. The groups $R_1$, $R_2$, $R_5$ and $R_6$ may have one or more substituent groups.

Examples of the substituent groups include an alkyl group, an aralkyl group, an alkoxy group, an aryl group, a substituted amino group, an acylamino group, a sulfonylamino group a ureido group, a urethane group, an aryloxy group, a sulfamoyl group, a carbamoyl group, an allyl group, an alkylthio group, an arylthio group, a sulfonyl group, a sulfinyl group, hydroxyl group, a halogen atom, cyano group, sulfo group and carboxyl group, each of which may be further substituted.

These groups may be combined together to form a ring, if desired.

$R_1$ and $R_2$ may be combined together with $L_1$ to form a ring. $R_1$ and $R_2$ may be combined together to form a ring, or may be cyclized to form a four-membered to seven-membered heterocyclic ring containing one or more hetero-atoms (e.g., oxygen atom, sulfur atom, nitrogen atom).

The bivalent group (i.e., the bivalent organic group) represented by $L_1$ is an atomic group containing at least one atom of C, N, S and O. For example, the bivalent organic group may be an alkylene group, an alkenylene group, an alkinylene group, an arylene group or a heteroarylene group (these groups may be optionally substituted) alone or a combination of two or more of them. Among them, the arylene group is preferred. Examples of the arylene group include phenylene naphthylene groups, each of which may optionally have one or more substituent groups. Examples of such substituent groups include an alkyl group, an aralkyl group, an alkoxy group, an aryl group, an aryloxy group, an alkenyl group, an alkylthio group, an arylthio group, a sulfonyl group, a sulfinyl group, a halogen atom, cyano group, an acyl group, nitro group and a group of ps

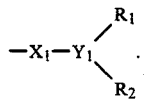

When $G_1$ is a carbonyl group, R3 is preferably a hydrogen atom, an alkyl group (e.g., methyl, trifluoromethyl, 3-hydroxypropyl, 3-methanesulfonamidopropyl, toluenesulfonylmethyl, cyanomethyl etc.), an aralkyl group (e.g., o-hydroxybenzyl) or an aryl group (e.g., pheny 1 , 3 , 5 -dichlorophenyl, 0-methanesulfonamidophenyl, 4-methanesulfonylphenyl). When $G_1$ is sulfonyl group, $R^3$ is preferably an alkyl group (e.g., methyl), an aralkyl group (e.g., 0-hydroxyphenylmethyl), an aryl group (e.g., phenyl) or a substituted amino group (e.g., dimethylamino).

When $G_1$ is a sulfoxy group, $R_3$ is preferably a cyanobenzyl group or a methylthiobenzyl group. When $G_1$ is a group of ps

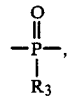

$R_3$ is preferably a methoxy group, an ethoxy group, a butoxy group, a phenoxy group or a phenyl group.

When $G_1$ is an N-substituted or unsubstituted iminomethylene group, $R_3$ is a methyl group, an ethyl group or a substituted or unsubstituted phenyl group.

Examples of substitutent groups for $R_3$ include an alkyl group, an aralkyl group, an alkoxy group, an aryl group, a substituted amino group, an acylamino group, a sulfonylamino group, a ureido group, an urethane group, an aryloxyg roup, a sulfamoyl group, a carbamoyl group, an alkylthio group, an arylthio group, a sulfonyl group, a sulfinyl group, hydroxyl group, a halogen atom, cyano group, sulfo gorup, carboxyl group, an acyloxy group, an acyl group, an alkyl- or aryloxycarbonyl group, an alkenyl group, an alkinyl group, ps

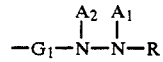

(wherein $G_1$, $A_1$ and $A_2$ are those described with respect to formula (I), a R represents an aliphatic group, an aromatic group or a heterocyclic group) and nitro group, each of of which may be further substituted.

These groups may be combined together to form a ring, if desired.

A Carbonyl group is particularly preferred as the group $G_1$. Preferred examples of $R_3$ are hydrogen atom and a group represented by formula (a). ps, ti $—L_2—Z_1$ tm (a) ps In the formula (a), $Z_1$ is a group which nucleophilically attacks $G_1$ to cleave the molecule and to release the moiety $G\text{-}L_2\text{-}Z_1$ from the molecule, and $L_2$ is a bivalent organic group which nucleophilically attacks $G_1$ to form a cyclic structure formed by $G_1$, $L_2$ and $Z_1$.

In more detail, $Z_1$ is such a group that when the following compound

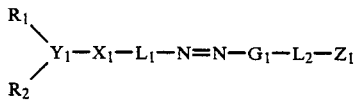

is formed, for example, by the oxidation of a hydrazine compound represented by formula (I), it nucleophilically attacks $G_1$ to release a group of

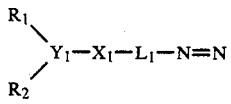

from $G_1$. Specific examples of the group $Z_1$ include OH, SH, $NHR_7$ (wherein $R_7$ is a hydrogen atom, an alkyl group, an aryl group, a heterocyclic group or a group of $—COR_8$ or $—SO_2R_8$ and $R_8$ is a hydrogen atom, an alkyl group, an aryl group or a heterocyclic group) and a functional group (e.g., COOH which can be directly reacted with $G_1$). OH, SH, $NHR_4$ and COOH may be temporarily protected so as to form these groups by hydrolysis with alkali, etc.

Alternatively, $Z_1$ may be a functional group such as

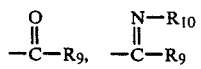

(wherein $R_9$ and $R_{10}$ are each hydrogen atom, an alkyl group, an alkenyl group, an aryl group or a heterocyclic group) which can be reacted with $G_1$ by the reaction with a nucleophilic agent such as hydroxyl ion or a sulfite ion.

The bivalent organic group represented by $L_2$ is at least one atom of C, N, S and O or an atomic group containing at least one atom of C, N, S and O. For example, the bivalent organic group represented by $L_2$ is composed of an alkylene group, an alkenylene group, an alkinylen group, an arylene group, a hetero-arylene group (these groups may be optionally substituted), —O—, —S—, ps

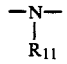

(wherein $R_{11}$ is a hydrogen atom, an alkyl group or an aryl group), —N=, —CO— or $—SO_2—$ alone or a combination of two or more of them. Preferred examples thereof are five-membered or six-membered rings formed by $G_1$, $Z_1$ and $L_2$.

Among the groups of the formula (a), groups represented by formulae (b) and (c) are preferred.

In formula (b), $R_b^1$ to $R_b^4$ may be the same or different and each may be a hydrogen atom, an alkyl group having preferably 1 to 12 carbon atoms, an alkenyl

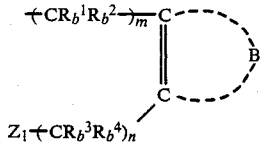

(b)

group having preferably 2 to 12 carbon atoms or an aryl group having preferably 6 to 12 carbon atoms; B is an atomic group (e.g., C, N, O and S) suitable for forming a five-membered or six-membered ring, which may be optionally substituted; m and n are each 0 or 1; when $Z_1$ is COOH, m+n is equal to 1; and when Z is OH, SH or $NHR_4$, m+n is equal to 1 or 2.

Examples of the five-membered or six-membered ring formed by B include a cyclohexene ring, cycloheptene ring, benzene ring, naphthalene ring, pyridine ring and quinoline ring. $Z_1$ is the same as those described with respect to formula (a).

Among the groups represented by formula (b), there are preferred groups where m=0 and n=1. The groups where B is a benzene ring, are particularly preferred.

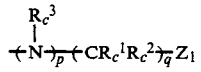

(c)

In formula (c), $R_c^1$ and $R_c^2$ are the same or different, and each is a hydrogen atom, an aklyl group, an alkenyl group, an aryl group or a halogen atom; $R_c^3$ is a hydrogen atom, an alkyl group, an alkenyl group or an aryl group; p is 0, 1 or 2; and q is from 1 to 4.

$R_c^1$, $R_c^2$ and $R_c^3$ may be combined together to form a ring, so long as $Z_1$ has a structure capable of nucleophilically attacking $G_1$.

Preferably, $R_c^1$ and $R_c^2$ are each a hydrogen atom, a halogen atom or an alkyl group. Preferably, $R_c3$ is an alkyl group or an aryl group.

Preferably, q is from 1 to 3. When q is 1, p is 1 or 2; when q is 2, p is 0 or 1; and when q is 3, p is 0 or 1. When q is 2 or 3, the $CR_c^1R_c^2$ groups may be the same or different.

$Z_1$ is the same as described with respect to formula (a).

$X_1$ is —O— or $—NR_4—$; and $R_4$ is a hydrogen atom, an alkyl group (e.g., methyl, ethyl, methoxyethyl) or an aryl group (e.g., phenyl) Preferably, $X_1$ is $—NR_4—$ and $R_4$ is a hydrogen atom.

$Y_1$ is ps

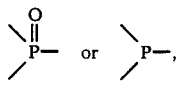

and preferably Y is ps

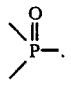

$R_1$, $R_2$, $L_1$ or $R_3$, particularly $R_1$ or $R_2$ is preferably one having a nondiffusion group such as a coupler, or so-called ballast group. The ballast group has not less than 8 carbon atoms and is composed of an alkyl group, a phenyl group, an ether group, an amido group, a ureido group, a urethane group, a sulfonamide group or a thioether group or a combination of two or more of them. Also, groups which are continually polymerized to a main chain of polymers in $R_1$, $R_2$ or $R_3$ are preferably used as the ballast group.

Further, $R_1$, $R_{b\,2}$, $L_1$, or $R_3$ (particularly $R_1$ or $R_2$ among these) is preferably one having an adsorption accelerating group $Y_2$-(-$L_3$-)- which allows the adsorption of the compounds having the formula (I) on the surface of silver halide to be accelerated.

$Y_2$ is an adsorption accelerating group on the surface of silver halide; $L_3$ is a bivalent group; and l is 0 or 1. Preferred examples of the adsorption accelerating group $Y_2$ on silver halide include a thioamide group, a mercapto group, a group having disulfide linkage or a five-membered or six-membered nitrogen containing heterocyclic group.

The thioamido group as the adsorption accelerating group represented by $Y_2$ is a bivalent group represented by ps

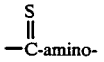

which may be part of a ring structure or a non-cyclic thioamido group. The thioamido group as the adsorption accelerating group useful in the present invention can be chosen from among those described in U.S. Pat. Nos. 4,030,925, 4,031,127, 4,080,207, 4,245,037, 4,255,511, 4,266,013 and 4,276,364 and *Research Disclosure*, Vol. 151, No. 15162 (Nov. 1976) and ibid., Vol. 176, No. 17626 (Dec. 1978).

Examples of the non-cyclic thioamido group include thioureido group, thiourethane group and dithiocarbamic ester group. Examples of cyclic thioamido groups include 4-thiazolin-2-thione, 4 imidazolin-2thione, 2-thiohydantoin, rhodanine, thiobarbituric acid, tetrazoline-5-thione, 1,2,4-triazoline-3-thione, 1,3,4- thiadiazoline-2-thione, 1,3,4-oxadiazoline 2-thione, benzimidazoline-2-thione, benzoxazoline-2-thione and benzthiazoline-2-thione. They may be further substituted.

The mercapto group represented by $Y_2$ includes aliphatic mercapto groups, aromatic mercapto groups and heterocyclic mercapto groups (when the atom next to carbon atom to which -SH group is attached is nitrogen atom, the group is the same as the cyclic thioamide group having a tautomeric relation thereto and examples thereof are those described above).

The five-membered or six membered nitrogen-containing groups represented by $Y_2$ include five-membered to six-membered nitrogen-containing heterocyclic rings composed of combinations of nitrogen, oxygen, sulfur and oxygen. Among them, there are preferred benztriazole, triazole, tetrazole, indazole, benzimidazole, imidazole, benzthiazole, thiazole, benzoxazole, oxazole, thiadiazole, oxadiazole and triazole. They may be optionally substituted. Examples of substituent groups are those already described above in the definitions of $R_1$ and $R_2$.

Among the groups represented by $Y_2$, there are preferred the cyclic thioamido groups such as mercapto substituted nitrogen-containing heterocyclic rings such as a 2-mercaptothiadiazole group, 3-mercapto-1,2,4-triazole group, 5-mercaptotetrazole group, 2-mercapto-1,3,4-oxadiazole group, and 2-mercaptobenzoxazole group and nitrogen-containing heterocyclic groups such as a benztriazole group, benzimidazole group, and imidazole group.

Two or more $Y_2$-(-$L_3$-)- groups may be substituted and they may be the same or different.

The bivalent bonding group represented by $L_3$ is at least one atom of C, N, S and O or an atomic group containing at least one atom of C, N, S and O. The bivalent bonding group is composed of an alkylene group, an alkenylene group, an alkinylene group, an arylene group, —O—, —S—, —NH—, —N=, —CO— or —$SO_2$— (these groups may be optionally substituted) alone or a combination of two or more of them.

Examples of these groups include those represented by the following formulae.

—CONH—, —NHCONH—, —$SO_2$NH—, —COO—,

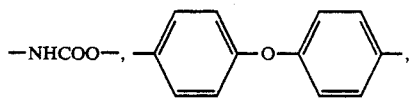

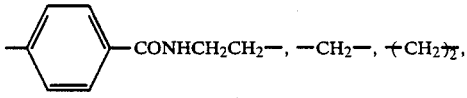

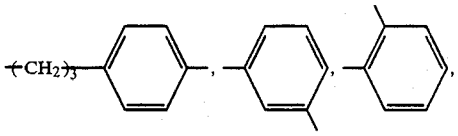

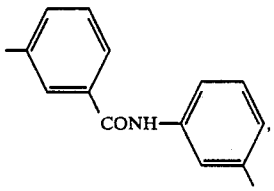

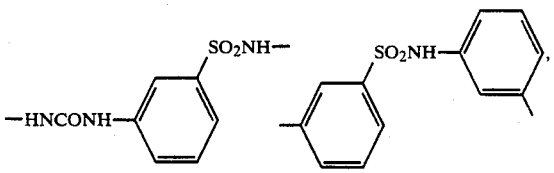

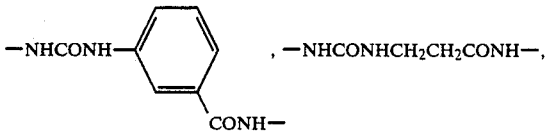

-continued

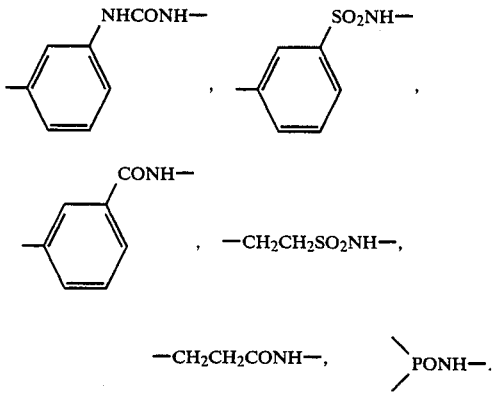

These groups may be further substituted. Examples of substituent grups are those already described above with respect to the definitions of $R_1$ and $R_2$.

Among the compounds represented by formula (I), compounds represented by formula (II) are preferred.

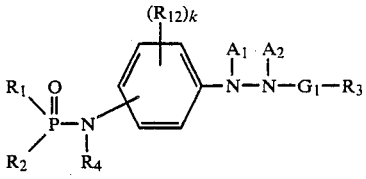

(II)

In the formula (II), $R_{12}$ has the same meaning as $R_1$ and $R_2$ of the formula (I); and k is 0, 1 or 2.

$R_1$, $R_2$, $R_3$, $R_4$, $A_1$, $A_2$ and $G_1$ have the same meaning as with respect to the formula (I).

There are preferred compounds where a group having the formula ps

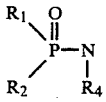

is substituted to the benzene ring at the O— or p-position against a hydrazine group.

Examples of the compounds represented by formula (I) include, but are not limited to, the following compounds.

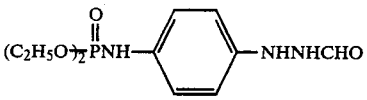

(I-1)

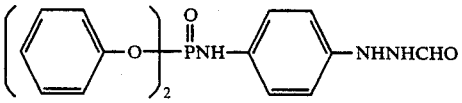

(I-2)

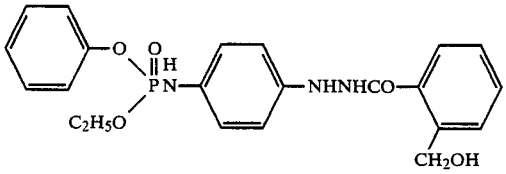

(I-3)

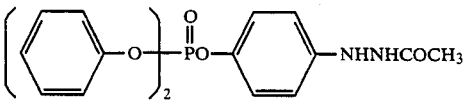

(I-4)

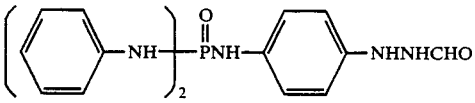

(I-5)

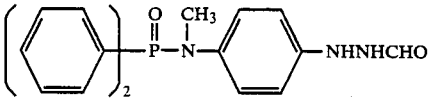

(I-6)

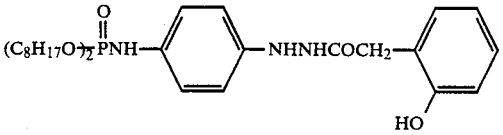

(I-7)

-continued
(I-8)
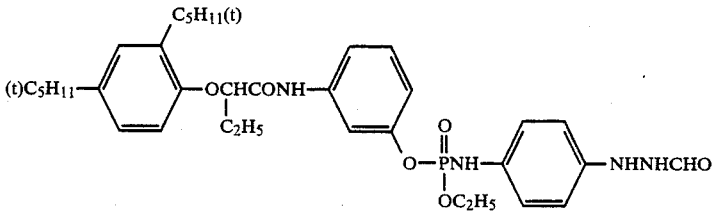
(I-9)
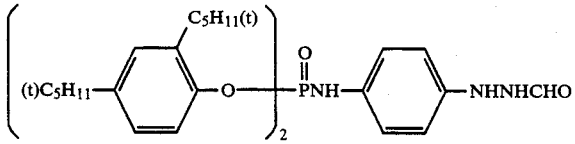
(I-10)
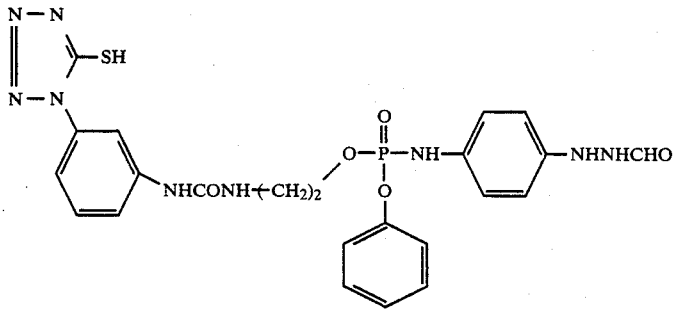
(I-11)
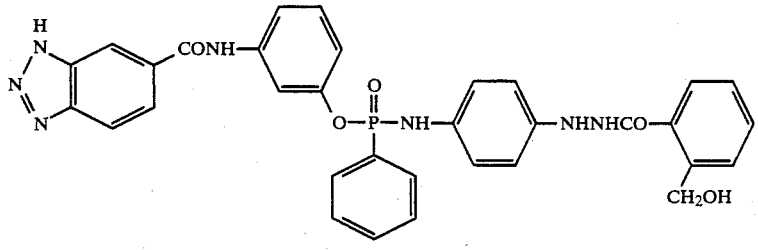
(I-12)
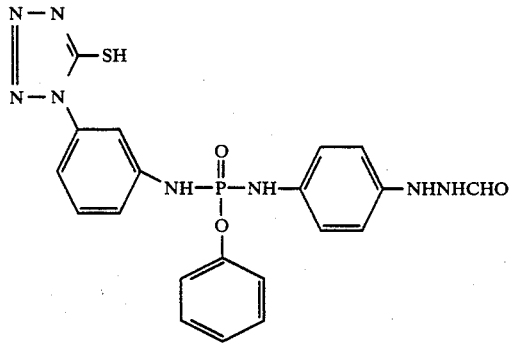
(I-13)
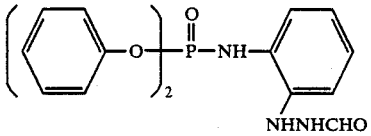

-continued
(I-14)
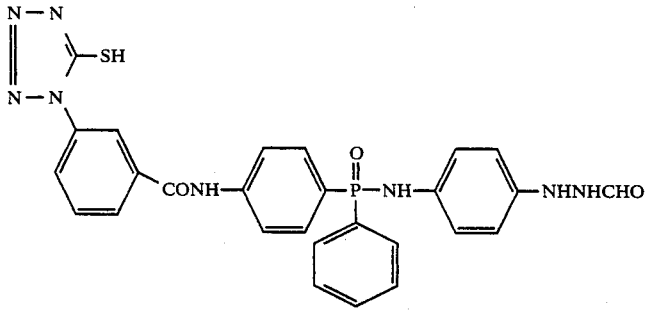
(I-15)
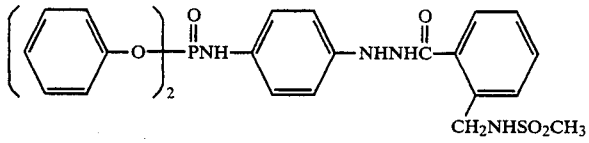
(I-16)
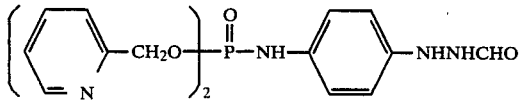
(I-17)
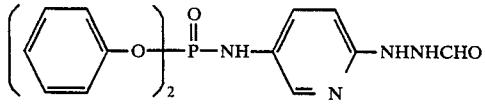
(I-18)
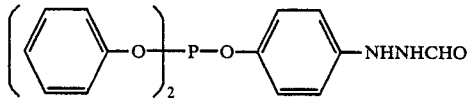
(I-19)
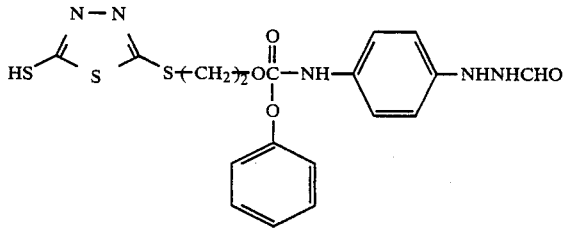
(I-20)
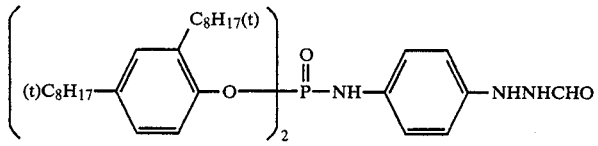
(I-21)
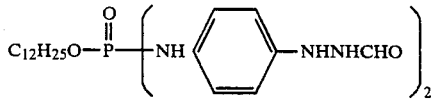
(I-22)
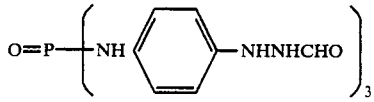
(I-23)
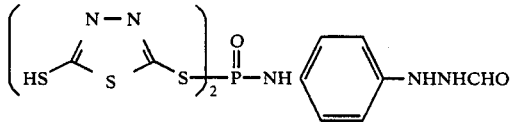

-continued

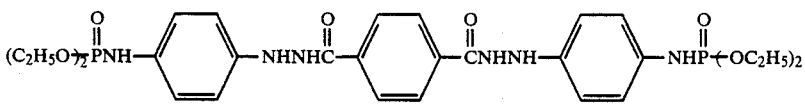

(I-24)

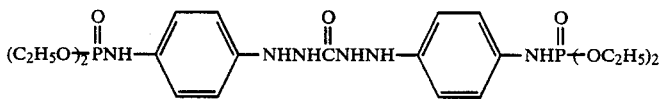

(I-25)

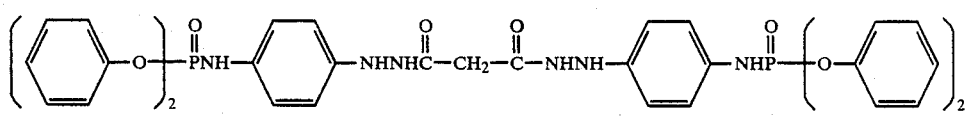

(I-26)

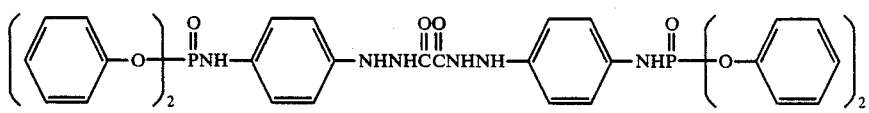

(I-27)

The compounds represented by formula (I) can be synthesized by methods described in the literature *Modern Organic Synthesis Series 5 Organic Phosphorus Compound*, edited by the society for Synthetic Organic Chemistry, a corporate juridical person; P. Brigl, H. Moller, Ber. 72 2121 (1939); V.V. Katyshkina, M. Ya. Kraft, Zh. Obshch, Khim. 26 3060 (1956); C.A. 51 8029*a* (1957); H.D. Orloff, C.J. Worrel, F.X. Moarkley, J. Am. Chem. Soc. 80 727 (1958); G. Jacobsen, Ber. 8 1519 (1875); M. Rapp, Ann. 224 156 (1884); R. Heim, Ber. 16 1763 (1883); Org. Synth. Coll. Vol. 2,110 (1943); A.E. Arbuzov, K.V. Nikonorov, Zh. Obshch. Khim. 17 2140(1947); C.A. 42 4246 h (1948); Org. Synth. 46 42 (1965); R.M. Isham, U.S. Pat. No. 2,662,095 (1948); C.A. 48 13709f (1954); G.A. Saul, K.L. Godfvey, Brit, P. 744,484 (1953); C.A. 50 16825 C (1956); H. Normant, Angew. Chem. 79 1029 (1967), etc.

Synthesis methods for compounds represented by formula (I) will be described by way of Example below.

Synthesis Example 1: Synthesis of exemplified compound 7.6 g (0.05 mol) of 2-(4-aminophenyl)-1-formylhydrazine was dissolved in 25 ml of dimethylformamide. While vigorusly stirring the resulting solution in a nitrogen atmosphere, 10.4 ml (0.05 mol) of diphenyl phosphorochloridate was added thereto. After the reaction mixture was cooled to 10° C. or lower, 5.7 ml of methylmorpholine was slowly added dropwise thereto. After addition, the temperature of the mixture was elevated to about 20° C. and the mixture was stirred for 30 minutes. The reaction mixture was introduced into 400 ml of water and extracted with ethyl acetate. The extract was dried over sodium sulfate and ethyl acetate was then distilled off. The oily residue was purified by means of silica gel column chromatography (elution with dichloromethane/methanol = 10/1) to give 8.9 g (46.6%) of the compound I-2 as an oil.

Synthesis Example 2 Synthesis of exemplified compound 6.0 g (0.04 mol) of 2-(4-aminophenyl)-1-formylhydrazine was dissolved in 20 ml of acetonitrile. While vigorusly stirring the resulting solution in a nitrogen atmosphere, 5.8 ml (0.04 mol) of diethyl phosphorochloridate was added thereto. After the reaction temperature was cooled to 10° C. or lower, 4.6 ml (0.04 mol) of methylmorpholine was slowly added dropwise thereto. After addition, the temperature of the reaction mixture was elevated to about 20° C. and the mixture was then stirred for one hour. The reaction mixture was filtered off. The filterate was concentrated under reduced pressure. The oily residue was purified by means of silica gel column chromatography (elution with ethyl acetate/methanol —4/1) to give 6.2 g (55.0%) of the compound I-1 as an oil.

The incorporation of the present compound in the photographic emulsion layer or hydrophilic colloid layer (preferably in the photographic emulsion layer) can be accomplished by dissolving the compound in water or an organic solvent miscible with water (optionally adding alkali hydroxide or a tertiary amine to the solution to make a salt which will be then dissolved in the solution), and then adding the solution to a hydrophilic colloid solution (e.g., aqueous solution of silver halide or gelatin) while the pH value thereof may be optionally adjusted with an acid or alkali.

The compounds of the present invention may be used, singly or in combination. The amount of the present compound to be incorporated is preferably in the range of from $1\times10^{-5}$ to $5\times10^{-2}$ mol and particularly preferably from $2\times10^{-5}$ to $1\times10^{-2}$ mol, per 1 mol of silver halide, and can be properly selected depending on the properties of the silver halide emulsion to be used in combination.

The compound represented by formula (I) can be used in combination with a negative type emulsion to form a negative image with a high contrast. The compound may be also used in combination with an internal latent image type silver halide emulsion. The compound may be preferably used in combination with a negative type emulsion to form a negative image with high contrast.

The average particle size of silver halide to be used in the formation of a negative image with a high contrast is preferably in the range of 0.7 μm or less (finely divided particle range) and particularly preferably 0.5 μm or less. The particle size distribution is not particularly limited but is preferably in the range of monodispersion. The term "monodispersion" as used herein means a particle composition such that at least 95 % by weight or number of the total particles have a particle size within ± 40% of the average particle size.

The silver halide grains to be incorporated in the photographic emulsion may have a regular crystal structure such as cubic, octahedron, rhombic dodecahedron, and tetradecahedron, an irregular crystal structure such as sphere and tabular, or a composite thereof.

The silver halide grains may have a structure such that the phase is uniform from the internal portion to the surface or different from the internal portion to the surface.

The silver halide emulsion to be used in the present invention may include cadmium salts, sulfites, lead salts, thallium salts, rhodium salts or complex salts thereof, or iridium salts or complex salts thereof in the process of formation or physical ripening, of silver halide grains.

The silver halide to be used in the present invention is prepared in the presence of an iridium salt or its complex salt in an amount of $I \times 10^{-8}$ to $I \times 1^{-5}$ mol per 1 mol of silver. The silver halide to be used in the present invention may be silver haloiodide having a greater silver iodide content in the surface thereof than the average silver iodide content. The use of an emulsion containing such a silver haloiodide provides a higher sensitivity and a higher gradation (i.e., a higher gamma value).

The silver halide emulsion to be used in the present invention may or may not be subjected to chemical sensitization. As methods for chemical sensitization of silver halide emulsions there have been known a sulfur sensitization process, reduction sensitization process and noble metal sensitization process. These chemical sensitization processes may be used, singly or in combination.

A typical example of noble metal sensitization process is the gold sensitization process using a gold compound, particularly a gold complex. The chemical sensitizing agent may comprise complexes of noble metals other than gold, such as platinum, palladium, or rhodium. Specific examples of such sensitizing agents are described in U.S. Pat. No. 2,448,060 and British Pat. No. 618,016. As sulfur sensitizing agents there may be used sulfur compounds contained in gelatin, or various sulfur compounds such as thiosulfates, thioureas, thiazoles and rhodanines.

An iridium salt or rhodium salt may be preferably used before the completion of physical ripening, particularly during the formation of grains, in the process of preparation of silver halide emulsion.

In the present invention, the silver halide emulsion layer may preferably contain two monodisperse emulsions having different average particle sizes as disclosed in JP-A-61-223,734 and 62-90,646 in the light of increase in the maximum density ($D_{max}$). The monodisperse grains having smaller average grain size may be preferably subjected to chemical sensitization. The chemical sensitization may be most preferably effected by sulfur sensitization. A monodisperse emulsion having greater average particle size may be or may not be subjected to chemical sensitization. A monodisperse emulsion having greater average particle size is normally susceptible to black pepper and, therefore, not subjected to chemical sensitization. However, if a monodisperse emulsion having greater average particle size is subjected to chemical sensitization, the chemical sensitization may be most preferably effected so lightly that the emulsion does not develop black pepper. That is, such a chemical sensitization can be accomplished by using shorter chemical sensitization time, a lower chemical sensitization temperature or a lower added amount of chemical sensitizers than chemical sensitization for a monodisperse emulsion having smaller average particle size. The difference in sensitivity between a monodisperse emulsion having greater average particle size and a monodisperse emulsion having smaller average particle size is not particularly limited. However, the difference is preferably in the range of from 0.1 to 1.0 and particularly preferably from 0.2 to 0.7 as calculated in terms of ΔlogE. A monodisperse emulsion having greater average particle size preferably has a higher sensitivity than a monodisperse emulsion having smaller average particle size. The sensitivity of each emulsion can be determined when a light-sensitive material is obtained by incorporating a hydrazine derivative in the emulsion and then coating the emulsion on a support and processing with a developing solution having a pH of 10.5 to 12.3 containing 0.15 mol/l or more of sulfinic acid ion. The average particle size of the small size monodisperse grains is 90 % or less and preferably 80 % or less of that of the large size monodisperse grains. The average particle size of the silver halide emulsion grains is preferably in the rang of from 0.02 to 1.0 μm and particularly preferably from 0.1 to 0.5 μm within which the average particle size of the large size and small size monodisperse grains preferably fall.

In the present invention, when two or more emulsions having different sizes are used, the coated amount of silver in the small size monodisperse emulsion is generally from 40 to 90 % by weight and particularly preferably from 50 to 80 % by weight based on the total coated amount of silver.

In the present invention, monodisperse emulsions having different particle sizes may be incorporated in the same emulsion layer or separately in separate emulsion layers. When the emulsions are incorporated in separate emulsion layers, the large size emulsion is preferably incorporated in the upper layer and the small size emulsion is preferably incorporated in the lower layer.

The total coated amount of silver is preferably in the range of from 1 to 8 g/m$^2$.

The light-sensitive material to be used in the present invention may comprise sensitizing dyes (e.g., cyanine dyes and melocyanine dyes) such as those described in JP-A-55-52050 (pp. 45–53) for the purpose of increasing sensitivity. These sensitizing dyes may be used, singly or in combination. Combinations of sensitizing dyes are often used particularly for the purpose of supersensitization. In combination with a sensitizing dye, a dye which has no spectral sensitizing effect itself or a substance which does not substantially absorb visible light but exhibits a supersensitizing effect may be incorporated in the emulsion. Useful sensitizing dyes, dye combinations exhibiting a supersensitizing effect and substances exhibiting a supersensitizing effect are described in Research Disclosure No. 17,643 (vol. 176, Dec. 1978, IV-J, page 23).

The photographic emulsion to be used in the present invention may comprise various compounds for the purpose of inhibiting fog during the preparation, preservation or photographic processing of the light-sensitive material or stabilizing the photographic properties thereof. Examples of such compounds include many compounds known as fog inhibitors (i.e., antifoggants) or stabilizers, such as azoles (e.g., benzothiazolium salt, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles ); mercaptopyrimidines; mercaptotriazines, thioketo compounds [e.g., oxazolinethione; azaindenes (e.g., triazaindenes, tetraazaindenes (particularly 4-hydroxy-substituted (1,3,3a,7) tetrazaindenes), pentaazaindenes]; benzenethiosulfonic acid; benzenesulfinic acid; and benzenesulfonic amide. Preferred among these compounds are benzotriazoles such as 5-methyl-benzotriazole and nitroindazoles such as 5-nitroindazole. These compounds may be incorporated in the processing solution.

As suitable development accelerators or nucleation infectious development accelerators there may be used compounds such as those disclosed in JP-A-53-7,616, 54-37,732, 53-137,133, 60-140,340, 60-14,959, 61-165752 and 63-106748 or various nitrogen- or sulfur-containing compounds.

The optimum amount of these accelerators to be incorporated depends on the type of accelerator but is normally in the range of from $1.0\times10^{-3}$ to 0.5 g/m$^2$ and preferably from $5.0\times10^{-3}$ to 0.1 g/m$^2$.

In the present light-sensitive material, a desensitizer ma be incorporated in the photographic emulsion layer or other hydrophilic colloidal layers.

The organic desensitizer to be used in the present invention is specified by the redox potential determined by its polarographic half wave potential, i.e., polarography such that the sum of the polarograph anodic potential and the polarograph cathodic potential is positive. The measurement of polarographic redox potential is described in e.g., U.S. Pat. No. 3,501,307. The organic desensitizer may preferably contain at least one water soluble group such as a sulfonic group, carboxylic group or sulfone group. These water-soluble groups may form salts with organic bases (e.g., ammonia, pyridine, triethylamine, piperidine, and morpholine) or alkaline metals (e.g., sodium, potassium).

As suitable organic desensitizers there may be preferably used those represented by the formulae (III) to (V) as described in JP-A-63-133145 (pp. 55–72).

The present organic desensitizer may be preferably present in the silver halide emulsion layer in an amount of from $1.0\times10^{-8}$ to $1.0\times10^{-4}$ mol/m$^2$ and particularly preferably from $1.0\times10^{-7}$ to $1.0\times10^{-5}$ mol/m$^2$.

The present emulsion layer or other hydrophilic colloidal layers may comprise water-soluble dyes as a filter dye or for the purpose of inhibiting irradiation, or for other various purposes. As such a filter dye there may be used a dye for reducing photographic sensitivity, preferably an ultraviolet absorber having a maximum spectral absorption in the inherent sensitivity region of silver halide or a dye with a substantial light absorption in the region of from 380 to 600 nm for improving the safety against safelight when the light-sensitive material is treated as a bright room-type light-sensitive material.

These dyes may be preferably incorporated and fixed in the emulsion layer or in the upper part of the silver halide emulsion layer, i.e., the light-insensitive hydrophilic colloidal layer farther than the silver halide emulsion layer with respect to the support, together with a mordant depending on the purpose of application.

The amount of these dyes to be incorporated depends on the molar absorption coefficient of ultraviolet absorber and is normally in the range of from $1\times10^{-2}$ to 1 g/m$^2$, and preferably from 50 mg to 500 mg/m$^2$.

The above described ultraviolet absorber may be incorporated in the coating solution in the form of a solution in a proper solvent such as water, alcohol (e.g., methanol, ethanol, propanol), acetone, methyl cellosolve or mixtures thereof.

As such an ultraviolet absorber there may be used an aryl-substituted benzotriazole compound, 4-thiazolidone compound, benzophenone compound, cinnamic ester compound, butadiene compound, benzooxazole compound or ultraviolet absorbing polymer.

Specific examples of such ultraviolet absorber are described in U.S. Pat. Nos. 3,533,794, 3,314,794, 3,352,681, 3,705,805, 3,707,375, 4,045,229, 3,700,455 and 3,499,762, JP-A-46-2,784 and West German Pat. Publication No. 1,547,863.

Examples of filter .dyes include oxonol dyes, hemioxonol dyes, styryl dyes, merocyanine dyes, cyanine dyes and azo dyes. In order to reduce residual color after development, a water-soluble dye or a dye decolorizable by an alkali or sulfinic ion may be preferably used.

Specific examples of such dyes which can be used in the present invention include pyrazoloneoxonol dyes such as those described in U.S. Pat. No. 2,274,782, diarylazo dyes such as those described in U.S. Pat. No. 2,956,879, styryl dyes or butadiene dyes such as those described in U.S. Pat. Nos. 3,423,207 and 3,384,487, merocyanine dyes such as those described in U.S. Pat. No. 2,527,583, merocyanine dyes or oxonol dyes such as those described in U.S. Pat. No. 3,486,897, 3,652,284 and 3,718,472, enaminohemioxonol dyes such as those described in U.S. Pat. No. 3,976,661, and dyes such as those described in British Pat. Nos. 584,609 and 1,177,429, JP-A-48-85,130, 49-99,620 and 49-114,420 and U.S. Pat. Nos. 2,533,472, 3,148,187, 3,177,078, 3,247,127, 3,540,887, 3,575,704 and 3,653,905.

These dyes may be incorporated in the coating solution for the present light insensitive hydrophilic colloidal layer in the form of a solution in a proper solvent such as water, alcohol (e.g., methanol, ethanol, propanol), acetone, methyl cellosolve or a mixture thereof.

The amount of these dyes to be used is normally in the range of from $1\times10^{-3}$ to 1 g/m$^2$ and particularly preferably from $1\times10^{-3}$ to 0.5 g/m$^2$.

The present photographic light-sensitive material may comprise an inorganic or organic film hardener in the photographic emulsion layer or other hydrophilic colloidal layers. As such a film hardener there may be used chromium salts, aldehydes such as formaldehyde and glutaraldehyde, N-methylol compounds such as dimethylolurea, active vinyl compounds such as 1,3,5-triacroyl-hexahydro s-triazine and 1,3-vinylsulfonyl-2-propanol, active halogen compounds such as 2,4-dichloro-6-hydroxy-s-triazine, and mucohalogenic acids, or combinations thereof.

The photographic emulsion layer or other hydrophilic colloidal layers in the light-sensitive material prepared according to the present invention may comprise various surface active agents for various purposes for example, as coating aids, as antistatic agents, for improvement of sliding properties, for improving emulsification and dispersion, for preventing adhesion, or for improving photographic properties such as acceleration of development, increase of contrast, and sensitization, or like purposes. As such surface active agents there may be particularly preferably used polyalkylene oxides having a molecular weight of 600 or more as described in JP-B-58-9,412 (the term "JP-B" as used herein means "examined Japanese patent publication"). As a surface active agent to be used as an antistatic agent there may be particularly preferably used a fluorine-containing surface active agent such as those in U.S. Pat. No. 4,201,586 and JP-A-60-80,849 and 59-74,554.

The present photographic light-sensitive material may comprise a matting agent such as silica, magnesium oxide or polymethyl methacrylate in the photographic emulsion layer or other hydrophilic colloidal layers for the purpose of preventing adhesion.

The present photographic emulsion may comprise a dispersion of a water-insoluble or sparingly water soluble synthetic polymer for the purpose of improving the dimensional stability. For example, a polymer comprising as monomer components alkyl (meth)acrylate alkoxyacryl (metha)acrylate, and glycidyl (metha)acrylate, singly or in combination, or a combination thereof with acrylic acid or methacrylic acid, may be used.

The silver halide emulsion layer and other layers in the present photographic light-sensitive material may preferably comprise a compound containing an acid group. Examples of such a compound containing an acid group include polymers or copolymers containing as repeating units organic acids such as salicylic acid, acetic acid or ascorbic acid, or acid monomers such as acrylic acid, maleic acid or phthalic acid. For these compounds, JP A-61-223,834, 61-228,437, 62-25,745 and 62-55,642 can be referenced. Particularly preferred as low molecular compounds among these compounds are ascorbic acids. Particularly preferred as high molecular compounds among these compounds are water-dispersible latexes of copolymer comprising acid monomers such as acrylic acid and crosslinking monomers containing two or more unsaturated groups such as divinyl benzene.

When the present silver halide light-sensitive material is used to obtain ultrahigh contrast and high sensitivity, it is not necessary to use a conventional infectious developing solution or a highly alkaline developing solution with a pH value of nearly 13 as described in U.S. Pat. No. 2,419,975. Rather, a stable developing solution may be used.

In particular, the present silver halide light-sensitive material may be processed with a developing solution containing 0.15 mol/l or more of sulfinic ion as a preservative and having a pH value of from 10.5 to 12.3 and particularly preferably from 11.0 to 12.0, to provide negative images with sufficiently ultrahigh contrast.

The developing agent to be incorporated in the present developing solution is not particularly limited. In order to assist in obtaining excellent halftone quality, the present developing agent may preferably contain dihydroxybnenzenes, or optionally a combination of dihydroxybenzenes and 1-phenyl-3-pyrazolidones, or a combination of dihydroxybenzenes and p-aminophenols. The present developing agent may be preferably used in an amount of from 0.05 to 0.8 mol/l. If a combination of dihydroxybenzenes and 1 phenyl-3-pyrazolidones or a combination of dihydroxybenzenes and p-aminophenols is used, the former may be preferably used in an amount of 0.05 to 0.5 mol/l or the latter may be preferably used in an amount of 0.06 mo/l or less.

Examples of sulfites to be used as preservatives in the present invention include sodium sulfite, potassium sulfite, lithium sulfite, ammonium sulfite, sodium bisulfite, potassium bisulfite, and formaldehyde sodium bisulfite. Such a sulfite may be preferably used in an amount of 0.4 mol/l or more and particularly preferably 0.5 mol/l or more.

The present developing solution may comprise as a silver stain inhibitor a compound such as those described in JP-A-56-24,347. As a dissolution aid to be incorporated in the developing solution there may be used a compound such as those described in JP-A-61-267,759. As a pH buffer to be incorporated in the developing solution there may be used a compound such as those described in JP A-60-93,433 or JP-A-62-186,259.

As described above, the compound represented by formula (I) may be incorporated in a high contrast light-sensitive material in combination with a negative type emulsion. Alternatively, the compound of formula (I) may be used in combination with an internal latent image type silver halide emulsion. Embodiments of such an arrangement will be described hereafter. In this case, the compound of formula (I) may be preferably incorporated in an internal latent image-type silver halide emulsion layer. Alternatively, the compound of formula (I) may be incorporated in a hydrophilic colloidal layer adjacent to the internal latent image-type silver halide emulsion layer. Such a hydrophilic colloidal layer may be a layer having any function so long as it does not prevent a nucleating agent from diffusing into silver halide grains. Examples of such a hydrophilic colloidal layer include coloring material layer, interlayer, filter layer, protective layer and antihalation layer.

The amount of compound (I) to be incorporated in the layer is preferably such amount that when the internal latent image type emulsion is developed with a surface developing solution sufficient maximum density (e.g., silver density of 1.0 or more) is provided. In particular, a suitable amount of the compound (I) to be incorporated in the layer depends on the properties of silver halide emulsion used, the chemical structure of nucleating agent and the developing conditions and therefore varies widely. However, a useful value of the amount of the compound (I) to be used in the layer is in the range of from about 0.005 to 500 mg and preferably from about 0.01 to about 100 mg, per 1 mol of silver in the internal latent image type silver halide emulsion. If compound (I) is incorporated in a hydrophilic colloidal layer adjacent to the emulsion layer, the same value as described above may be used based on the amount of silver contained in the same area of the internal latent image-type emulsion layer. The definition of such an internal latent image-type silver halide emulsion is describe in JP A-61-170,733 (upper column on page 10) and British Patent No. 2,089,057 (pp. 18-20).

Examples of suitable internal latent image type emulsions which can be used in the present invention are described in JP-A-63-108336 (line 14 on page 28 to line 2 on page 31). Examples of suitable silver halide grains which can be used in the present invention are described in JP-A-63-108336 (line 3 on page 31 to line 11 on page 32).

In the present light-sensitive material, the internal latent image type emulsion may be spectrally sensitized with a sensitizing dye to blue light, green light, red light or infrared light in a relatively long wavelength. As such a sensitizing dye there may be used a cyanine dye, merocyanine dye, complex cyanine dye, complex merocyanine dye, holopolar cyanine dye, styryl dye, hemicyanine dye, oxonol dye or hemioxonol dye. Examples of these sensitizing dyes include cyanine dyes or merocyanine dyes such as those described in JP-A-59-40,638, 59-40,636 and 59-38,739.

The present light-sensitive material may include a dye forming coupler as a coloring material. Alternatively, the present light-sensitive material may be developed with a developing solution containing such a dye-forming coupler.

Specific examples of these cyan, magenta and yellow couplers which can be used in the present invention are described in the patents cited in Research Disclosure Nos. 17,643 (Dec. 1978, VII-D) and 18,717 (Nov. 1979).

Couplers which develop a dye having a proper diffusivity, colorless couplers, DIR couplers which undergo coupling reaction to release a development inhibitor or couplers which undergo coupling reaction to release a development accelerator may be used in the present invention.

Typical examples of yellow couplers which may be used in the present invention include oil protect type acylacetamide couplers.

In the present invention, two-equivalent yellow couplers may preferably used. Typical examples of such two-equivalent yellow couplers include oxygen atom-releasing type yellow couplers and nitrogen atom-releasing type yellow couplers. α-Pivaloylacetanilide couplers provide excellent fastness of color forming dye and particularly fastness to light. α-benzoylacetanilide couplers can provide a high color density.

As a suitable magenta coupler for the present invention there may be used an oil protect type indazolone or cyanoacetyl and preferably a 5-pyrazolone coupler or a pyrazoloazole coupler such as pyrazolotriazoles. As such a 5-pyrazolone coupler there may be preferably used a coupler which is substituted by an arylamino group or acylamino group in the 3-position in the light of hue of color forming dye or color density.

Particularly preferred examples of releasing groups for such a two-equivalent 5-pyrazolone coupler include nitrogen atom releasing groups such as those described in U.S. Pat. No. 4,310,619 and arylthio groups such as those described in U.S. Pat. No. 4,351,897. 5- Pyrazolone couplers containing ballast groups such as those described in European Patent No. 73,636, can provide high color density.

As suitable pyrazoloazole couplers there may be used pyrazolobenzimidazoles such as those described in U.S. Pat. No. 3,379,899 and preferably pyrazolo [5,1c][1,2,4]triazoles such as those described in U.S. Pat. No. 3,725,067, pyrazolotetrazoles such as those described in Research Disclosure No. 24,220 (June 1984) or pyrazolopyrazoles such as those described in Research Disclosure No. 24,230 (June 1984). Imidazo[1,2b]pyrazoles such as those described in European Patent No. 119,741 may be preferably used because of their small subsidiary absorption of yellow light by color forming dye and excellent fastness of color forming dye to light. Pyrazolo[1,5-b][1,2,4]triazoles such as those described in European Patent No. 119,860 may particularly preferably be used in the present invention.

As a suitable cyan coupler for the present invention there may be used an oil protect type naphthol or phenol coupler. Typical examples of such a coupler include naphthol couplers as described in U.S. Pat. No. 2,474,293. Preferred examples of such a coupler include oxygen atom-releasing type two-equivalent naphthol couplers as described in U.S. Pat. Nos. 4,052,212, 4,146,396, 4,228,233, and 4,296,200. Specific examples of such a phenol coupler are described in U.S. Pat. Nos. 2,369,929, 2,801,171; 2,772,162 and 2,895,826. Cyan couplers which are fast to heat and moisture may be preferably used in the present invention. Typical examples of such cyan couplers include phenol cyan couplers containing an ethyl group or higher group in the meta-position of phenol nucleus, 2,5-diacylaminosubstituted phenol couplers and phenol couplers containing a phenylureido group in the 2-position and an acylamino group in the 5-position such as those described in U.S. Pat. No. 3,772,002.

In order to eliminate undesirable absorption of short wavelength range by a dye produced from a magenta or cyan coupler, a color negative light sensitive material for use in cameras may preferably comprise a colored coupler.

The graininess of the light sensitive material can be improved by using a coupler which contains color dye having a proper diffusibility. Specific examples of such a dye-diffusible coupler are provided in U.S. Pat. No. 4,366,237 and British Patent No. 2,125,570. Specific examples of yellow, magenta or cyan couplers having a proper diffusibility are described in European Patent No. 96,470 and West German Patent No. application (OLS) No. 3,234,533.

Dye-forming couplers and the above described special couplers may form a dimer or higher polymer. Typical examples of polymerized dye-forming couplers are described in U.S. Pat. Nos. 3,451,820 and 4,080,211. Specific examples of polymerized magenta couplers are described in British Patent No. 2,102,173 and U.S. Pat. No. 4,367,282.

In order to satisfy the properties required for light-sensitive materials, the various couplers may be incorporated in combination in the same light-sensitive layer or singly in two or more different light-sensitive layers.

The standard amount of color coupler to be used is in the range of from 0.001 to 1 mol per 1 mol of light-sensitive silver halide. Preferably, yellow couplers are used in an amount of from 0.01 to 0.5 mol per 1 mol of light-sensitive silver halide, magenta couplers are used in an amount of 0.003 to 0.3 mol per 1 mol of light-sensitive silver halide, and cyan couplers are used in an amount of 0.002 to 0.3 mol per 1 mol of light-sensitive silver halide.

In the present invention, a developing agent such as hydroxybenzenes (e.g., hydroquinones), aminophenols or 3- pyrazolidones may be incorporated in the light-sensitive material.

The photographic emulsion to be used in the present invention may be also used in combination with a dye-providing compound (coloring material) for color diffusion transfer process which releases a diffusible dye in correspondence to the development of silver halide in order to provide transferred images on the image receiving layer after a proper development process. As such coloring materials there have been known many coloring materials. In particular, a coloring material which normally stays nondiffusive but undergoes redox reaction with an oxidation product of a developing agent (or electron transfer agent) to make cleavage, causing the release of a diffusible dye, may be preferably used (hereinafter to referred to as "DRR compound"). Particularly preferred among these DRR compounds are DRR compounds containing N-substituted sulfamoyl groups. DRR compounds containing o-hydroxyarylsulfamoyl groups such as those described in U.S. Pat. Nos. 4,055,428, 4,053,312 and 4,336,322 or DRR compounds containing redox mother nucleus such as those described in JP-A-53-149,328 may be preferably used in combination with the present nucleating agents. The combined use of such a DRR compound gives a rather small temperature dependence particularly during process.

Specific examples of DRR compounds further include magenta dye-forming materials such as 1-hydroxy-2-tetramethylenesulfamoyl-4-[3'-methyl-4'-(2''-hydroxy-4''-methyl-5''-hexadecyloxyphenylsulfamoyl)-phenylazo]-naphthalen and yellow dye-forming materials.

The details of color couplers which can be preferably used in the present invention are provided in JP-A-53-149,328 (line 18 on page 33 - end of page 40).

The present light-sensitive material, which has been imagewise exposed to light, may be preferably color-developed with a surface developing solution, having a pH value of 11.5 or less containing an aromatic primary amine color developing agent after or while being fogged with light or a nucleating agent, and then bleached and fixed to provide direct positive color images. The pH value of the developing solution may be preferably in the range of 10.0 to 11.0.

The fogging process may be effected in either a so-called "light fogging process" by which the entire surface of the light-sensitive layer is given a second exposure or a so-called "chemical fogging process" by which the light-sensitive material is developed in the presence of a nucleating agent. The present light-sensitive material may be developed in the presence of a nucleating agent and fogging light. Alternatively, a light-sensitive material containing a nucleating agent may be fogwise exposed to light.

The details of the light fogging process are provided in JP-A-63-108336 (line 4 on page 47 - line 5 on page 49). The details of nucleating agents which can be used in the present invention are provided in JP-A63-108336 (line 6 on page 49 - line 2 on page 67). In particular, the compounds represented by formulae [N-1]and [N-2]may be preferably used in the present invention. Specific examples of these compounds include those represented by the formulae [N-I-1]to [N-I- 10]described on pages 56 to 58 in the above Japanese patent application and those represented by the formulae [N-II-1]to [N-II-12]are described on pages 63 to 66 of that patent application.

Details of nucleation accelerating agents which can be used in the present invention are also provided in the above Japanese patent application (see line 11 on page 68 - line 3 on page 71). Particularly preferred among these nucleation accelerators are those represented by the formulae (A-1) to (A-13) described on pages 69 to 70 of the above patent application.

Details of color developing solutions which can be used in the development of the present light-sensitive material are provided on page 71, line 4 to page 72, line 9 of the above Japanese patent application. Specific examples of aromatic primary amine color developing agents which can be preferably used in the present invention include p-phenylenediamine compounds. Typical examples of such p-phenylenediamine compounds include 3-methyl-4-amino-N-ethyl-N-(β-methanesulfonamidoethyl) aniline, 3-methyl-4-amino-N-ethyl-N-(β-hydroxyethyl)aniline, 3-methyl-4-amino-N-ethyl-N-methoxyethylaniline, and sulfates and hydrochlorides thereof.

When the present light-sensitive material is subjected to color diffusion transfer processing to form direct positive color images thereon, there may be used a black-and-white developing agent such as phenidone derivative in addition to the above described color developing agent.

A photographic emulsion layer which has been color developed is normally subjected to bleaching. The bleaching may be effected simultaneously with fixation (combined bleaching and fixing) or separately from fixation. In order to further expedite the processing bleaching may be followed by blixing, or fixation may be followed by blixing. The present bleaching solution or blixing solution may formally comprise an iron aminopolycarboxylate complex as the bleaching agent. As additives to be incorporated in the present bleaching solution or blixing solution there may be used various compounds such as those described in JP-A-62-215272 (pp. 22–30). The desilvering process (blixing or fixation) may be followed by rinse and/or stabilization. The rinsing solution or stabilizing solution may preferably comprise softened water. In the process for softening water, an ion exchange resin or reverse osmosis apparatus as described in JP-A-62-288,838 may be used. Specific examples of such a water softening process which can be used in the present invention, are described in JP-A-62-288,838.

As additives to be incorporated in the rinsing solution or stabilizing solution there may be used various compounds such as those described in JP-A-62-215,272 (pp. 30–36).

The less replenisher of each processing solution, the better the resulting property. The replenished amount of each processing solution is preferably in the range of from 0.1 to 50 times and particularly preferably from 3 to 30 times the amount of the solution carried over by the light-sensitive material from the prebath per unit area.

In the interest of bravity and conciseness, the contents of the aforementioned numerous patent and articles are hereby incorporated by reference.

The present invention is now illustrated in greater detail by reference to the following examples which, however, are not to be construed as limiting the invention in any may.

EXAMPLE 1

An aqueous solution of silver nitrate and an aqueous solution containing potassium iodide and potassium bromide were simultaneously added to an aqueous gelatin solution kept at 50° C. in the presence of $4\times10^{-7}$ mol (per mol of silver) of potassium iridium (III) chloride and ammonia over a period of 60 minutes while maintaining the pAg at 7.8, to prepare a cubic monodisperse emulsion having a mean grain size of 0.28 μm and an average silver iodide content of 0.3 mol%. After the emulsion was desalted by a flocculation method, 40 g (per mol of silver) of inactive gelatin was added thereto. The temperature of the emulsion was kept at 50° C. and 5,5' dichloro-9-ethyl-3,3'-bis-(3-sulfopropyl)oxacarbocyanine as a sensitizing dye and $1\times10^{-3}$ mol (per mol of silver) of a KI solution was added thereto. After a lapse of 15 minutes, the temperature was allowed to drop.

The emulsion was re-dissolved and the compounds represented by formula (I) set forth in Table 1 were added thereto at 40° C. 0.5 mol (per mol of silver) of hydroquinone was added thereto. Further, 5-methylbenztriazole, 4-hydroxy-1,3,3a,7-tetrazaindene, a polyethyl acrylate latex and 1,3-vinylsulfonyl-2-propanol as a hardener for gelatin were added thereto. The surface of a polyester film (150 μm) having a subbing layer (0.5 μm) composed of a vinylidene chloride copolymer was coated with the resulting emulsion in such an amount as to give a coating amount of 3.4 g/m² in terms of silver.

On the surface of the resulting coated film, there was then provided a layer comprising gelatin (1.5 g/m²), polymethyl methacrylate particles (average particle diameter: 2.5 μm, amount: 0.3 g/m²) and subsequently a protective layer comprising the following surfactants.

| Surfactant | |
|---|---|
| 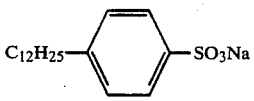 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2NCH_2COOK$<br>\|<br>$C_3H_7$ | 2.5 mg/m² |

For the purpose of comparison, a sample containing no nucleating agent was prepared, and samples were prepared by using each of the following comparative compounds A and B rather than the compounds having the formula (I). In this way, there were obtained comparative samples 1 to 3.

Comparative Compound A

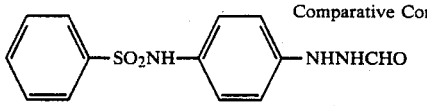

Comparative Compound B

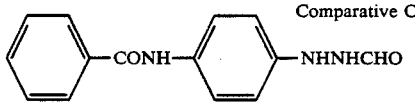

These samples were exposed through optical wedge by using tungsten light of 3200°K, developed at 34° C. for 30 seconds with the developing solution A, fixed, rinsed and then dried, by an ordinary method which is well-known.

The resulting photographic characteristics are shown in Table 1. It is apparent from the results of Table 1 that any of the samples of the present invention exhibits high sensitivity and high contrast.

Formulation of Developing Solution

| | Developing Solution A |
|---|---|
| Hydroquinone | 45.0 g |
| N-Methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| 2-Mercaptobenzimidazole-5-sulfonic acid | 0.3 g |
| n-Butylethanolamine | 15.0 g |
| Water to make | 1 liter |
| pH (adjusted by adding potassium hydroxide) | 11.6 |

TABLE 1

| | Hydrazine Compound | | Sensitivity* | Gradation** |
|---|---|---|---|---|
| | Compound | Amount (mol/Ag mol) | (S) | (γ) |
| 1 Comparative Sample-1 | — | — | Standard | 2.7 |
| 2 Comparative Sample-2 | Comparative Compound-A | $4.2 \times 10^{-4}$ | +0.73 | 5.6 |
| 3 Comparative Sample-3 | Comparative Compound-B | " | +0.49 | 4.8 |
| 4 Sample 1-1 (Invention) | Compound I-2 | " | +0.86 | 18.4 |
| 5 Sample 1-2 (Invention) | Compound I-3 | " | +0.93 | 19.6 |
| 6 Sample 1-3 (Invention) | Compound I-5 | " | +0.78 | 15.1 |
| 7 Sample 1-4 (Invention) | Compound I-7 | " | +0.75 | 12.4 |
| 8 Sample 1-5 (Invention) | Compound I-9 | " | +0.84 | 18.0 |
| 9 Sample 1-6 (Invention) | Compound I-10 | $5.6 \times 10^{-5}$ | +0.61 | 23.1 |
| 10 Sample 1-7 (Invention) | Compound I-11 | " | +0.56 | 12.3 |
| 11 Sample 1-8 (Invention) | Compound I-12 | " | +0.72 | 25.5 |

*Sensitivity: The sensitivity (log E) of Comparative Sample 1 is referred to as the standard and sensitivity is expressed by a difference between the standard and each sample. The sensitivity is expressed by logarithmic value (log E) of exposure amount which gives a density of 1.5

**Gradation (γ): Gradient of a straight line formed by joining a point, where density is 0.3 on the characteristic curve, to a point where density is 3.0. A larger value means higher contrast.

EXAMPLE 2

In addition to the developing solution A, the amount of KOH was finely changed to prepare five developing solutions having pH of 11.6, 11.4, 11.2, 11.0 and 10.8. The samples 1-1, 1-2, 1-9 and 1-12 of Example 1 and Comparative Sample 2 and 3 were processed by using these developing solutions in the same way as in Example 1.

The gradation (γ) of the resulting photographic characteristics are shown in Table 2. The sensitivity is changed according to gradation. It is apparent from the results of Table 2 that the samples of the invention retain high contrast, even when pH is lowered to 10.8.

TABLE 2

| | Gradation (γ) pH of Developing Solution | | | | |
|---|---|---|---|---|---|
| | 11.6 | 11.4 | 11.2 | 11.0 | 10.8 |
| 1 Comparative Sample 2 | 5.6 | 5.5 | 5.5 | 5.4 | 5.3 |
| 2 Comparative Sample 3 | 4.8 | 4.8 | 4.5 | 4.5 | 4.1 |
| 3 Sample 1-1 (Invention) | 18.4 | 17.1 | 15.0 | 12.6 | 10.2 |
| 4 Sample 1-2 (Invention) | 19.6 | 18.3 | 17.7 | 15.1 | 11.3 |
| 5 Sample 1-3 (Invention) | 15.1 | 13.8 | 12.5 | 10.6 | 8.9 |
| 6 Sample 1-4 (Invention) | 12.4 | 11.9 | 11.4 | 10.8 | 10.2 |

EXAMPLE 3

An aqueous solution of silver nitrate and an aqueous solution of sodium chloride were added simultaneously to an aqueous gelatin solution kept at 30° C. in the presence of $5.0\times10^{-6}$ mol (per mol of silver) of $(NH_4)_3RhCl_6$. After soluble salt was removed from the mixture by a well-known method, gelatin was added thereto. Without carrying out chemical ripening, 2-methyl-4-hydroxy-1,3,3*a*,7-tetraazaindene as a stabilizer was added thereto. The resulting emulsion was a monodisperse emulsion having a mean grain size of 0.08 μm in the form of a cubic system.

The compounds represented by formula (I) in amounts given in Table 3 were added to the emulsion. The following accelerator (0.1 g/m$^2$) was then added thereto.

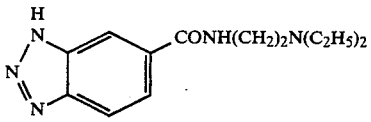

Further, 30 wt. % (on a solid basis; based on the amount of gelatin) of polyethyl acrylate latex was added thereto. Thereafter, 1,3-vinyl-sulfonyl-2-propanol as a hardening agent was added thereto. The surface of a polyester support was coated with the resulting emulsion in such an amount as to give a coating amount of 3.8 g/m$^2$ in terms of Ag. The coating amount of gelatin was 1.8 g/m$^2$. On the surface of the coated support, there was then provided a coating layer comprising gelatin (1.5 g/m$^2$) and polymethyl methacrylate (particle size: 2.5 μm, coating amount: 0.3 g/m$^2$) as a protective layer.

In the same way as in Example 1, comparative samples 4 to 6 were prepared. These samples were exposed through optical wedge using a printer p-607 for bright room (manufactured by Dainippon Screen KK) and developed at 38° C. for 20 seconds using the developing solution A and a developing solution obtained by lowering the pH of the developing solution A to 10.8. Thereafter, fixing, rinsing and drying were carried out.

The resulting photographic characteristics are shown in Table 3.

It is apparent from the results of Table 3 that the samples of the present invention have high contrast (65)as compared with comparative samples.

For example, at pH of 10.8, high contrast can scarcely be imparted to comparative samples, while high contrast can be imparted to the samples of present the invention.

EXAMPLE 4

A multi-layer color photographic material No. A, having the following layer structure, was prepared. A paper support (polyethylene was laminated onto both sides thereof) was used.

| |
|---|
| E9 Layer Protective layer |
| E8 Layer Ultraviolet light absorbing layer |
| E7 Layer Blue-sensitive layer |
| E6 Layer Interlayer |
| E5 Layer Yellow filter layer |
| E4 Layer Interlayer |
| E3 Layer Green-sensitive layer |
| E2 Layer Interlayer |
| E1 Layer Red-sensitive layer |
| Support |
| B1 Layer Backing layer |
| B2 Layer Protective layer |

Layer Structure

Each layer has the following composition. Numerals represent coating amount in the unit of g/m$^2$. The amount of each of silver halide emulsion and colloidal silver is coating amount (g) in terms of silver. The amount of spectral sensitizing dye to be added is mol per mol of silver halide.

Support

The support as a Polyethylene-laminated paper wherein the polyethylene on the side of the E1 layer contains a white pigment ($TiO_2$) and a bluish dye (ultramarine)

| | |
|---|---|
| E1 Layer | |
| Silver halide emulsion A | 0.26 |
| Spectral sensitizing dye (ExSS-1) | $1.0\times10^{-4}$ |
| Spectral sensitizing dye (ExSS-1) | $6.1\times10^{-5}$ |
| Gelatin | 1.11 |
| Cyan coupler (ExCC-1) | 0.21 |
| Cyan coupler (ExCC-2) | 0.26 |
| Ultraviolet light absorber (ExUV-1) | 0.17 |
| Solvent (ExS-1) | 0.23 |
| Development adjustor (ExGC-1) | 0.02 |
| Stabilizer (ExA-1) | 0.006 |
| Nucleating accelerator (ExZS-1) | $3.0\times10^{-4}$ |
| Nucleating agent (ExZK-1) | $8.0\times10^{-5}$ |
| E2 Layer | |
| Gelatin | 1.41 |
| Color mixing inhibitor (ExKB-1) | 0.09 |
| Solvent (ExS-1) | 0.10 |
| Solvent (ExS-2) | 0.10 |
| E3 Layer | |
| Silver halide emulsion A | 0.23 |
| Spectral sensitizing dye (ExSS-3) | $3.0\times10^{-4}$ |

TABLE 3

| | Hydrazine Compound | | Developing Solution (pH 11.6) | | Developing Solution (pH 10.8) | |
|---|---|---|---|---|---|---|
| | Compound | Amount (mol/Ag-mol) | S | γ | S | γ |
| 1 Comparative Sample-4 | — | — | Standard | 5.7 | Standard | 5.1 |
| 2 Comparative Sample-5 | Comparative Compound-A | $6.0\times10^{-3}$ | +0.15 | 8.3 | +0.03 | 5.4 |
| 3 Comparative Sample-6 | Comparative Compound-B | " | +0.31 | 10.2 | +0.03 | 5.8 |
| 4 Sample 2-1 (Invention) | Compound I-2 | " | 0.47 | 15.1 | +0.12 | 8.6 |
| 5 Sample 2-2 (Invention) | Compound I-3 | " | +0.42 | 14.8 | +0.25 | 9.0 |
| 6 Sample 2-3 (Invention) | Compound I-10 | $1.2\times10^{-3}$ | +0.49 | 15.4 | +0.26 | 9.5 |
| 7 Sample 2-4 (Invention) | Compound I-12 | " | +0.55 | 19.3 | +0.31 | 10.3 |

*S: Sensitivity
γ: Gradation

-continued

| | |
|---|---|
| Gelatin | 1.05 |
| Magenta coupler (ExMC-1) | 0.16 |
| Dye image stabilizer (ExSA-1) | 0.20 |
| Solvent (ExS-3) | 0.25 |
| Development adjustor (ExGC-1) | 0.02 |
| Stabilizer (ExA-1) | 0.006 |
| Nucleating accelerator (ExZS-1) | $2.7 \times 10^{-4}$ |
| Nucleating agent (ExZK-1) | $1.4 \times 10^{-4}$ |
| E4 Layer | |
| Gelatin | 0.47 |
| Color mixing inhibitor (ExKB-1) | 0.03 |
| Solvent (ExS-1) | 0.03 |
| Solvent (ExS-2) | 0.03 |
| E5 Layer | |
| Colloidal silver | 0.09 |
| Gelatin | 0.49 |
| Color mixing inhibitor (ExKB-1) | 0.03 |
| Solvent (ExS-1) | 0.03 |
| Solvent (ExS-2) | 0.03 |
| E6 Layer | |
| The same as the E4 layer. | |
| E7 Layer | |
| Silver halide emulsion A | 0.40 |
| Spectral sensitizing dye (ExSS-4) | $4.2 \times 10^{-4}$ |
| Gelatin | 2.17 |
| Yellow coupler (ExYC-1) | 0.51 |
| Solvent (ExS-2) | 0.20 |
| Solvent (ExS-4) | 0.20 |
| Development adjustor (ExGC-1) | 0.06 |
| Stabilizer (ExA-1) | 0.001 |
| Nucleating accelerator (ExZS-1) | $5.0 \times 10^{-4}$ |
| Nucleating agent (ExZK-1) | $1.2 \times 10^{-5}$ |
| E8 Layer | |
| Gelatin | 0.54 |
| Ultraviolet light absorber (ExUV-2) | 0.21 |
| Solvent (ExS-4) | 0.08 |
| E9 Layer | |
| Gelatin | 1.28 |
| Acrylic-modified copolymer of polyvinyl alcohol (degree of modification: 17%) | 0.17 |
| Liquid paraffin | 0.03 |
| Latex particles of polymethyl methacrylate (average particle diameter: 2.8 μm) | 0.05 |
| B1 Layer | |
| Gelatin | 8.70 |

-continued

| |
|---|
| B2 Layer |
| The same as the E9 layer. |

In addition to the above-described composition, a gelatin hardener (ExGK 1) and surfactant were added to each layer.

Silver Halide Emulsion A

An aqueous solution of a mixture of potassium bromide and sodium chloride and an aqueous solution of silver nitrate were simultaneously added to an aqueous gelatin solution containing 0.5 g (per mol of Ag) of 3,4-dimethyl-1,3-thiazoline-2-thione and 0.3 g of lead acetate at 55° C. over a period of about 5 minutes while vigorously stirring, to obtain a monodisperse silver chlorobromide emulsion having a mean grain size of about 0.2 μm and a silver bromide content of 40 mol%, and 35 mg (per mol of silver) of sodium thiosulfate and 20 mg (per mol of silver) of chloroauric acid tetrahydrate were added to the emulsion and the mixture was heated at 55° C. for 60 minutes to carry out chemical sensitization.

The thus-obtained silver chlorobromide grains were used as a core and processed further for 40 minutes under the same precipitation conditions as those of the first processing to further grow them, and then to finally obtain a monodisperse core/shell type silver chlorobromide emulsion having a mean grain size of 0.4 μm. The coefficient of variation in grain size was about 10%.

3 mg (per mol of silver) of sodium thiosulfate and 3.5 mg (per mol of silver) of chloroauric acid tetrahydrate were added to the emulsion and the mixture was heated at 60° C. for 50 minutes to carry out chemical sensitization to obtain an internal latent image type silver halide emulsion A.

The following compounds were used for the preparation of the sample.

(ExCC-1) Cyan coupler

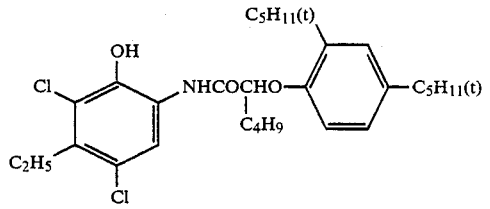

(ExCC-2) Cyan coupler

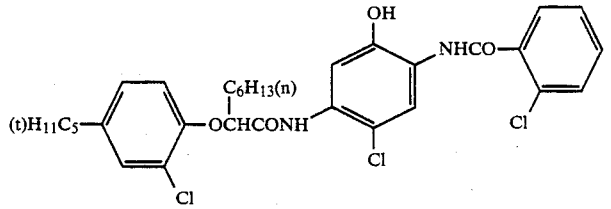

(ExMC-1) Magenta coupler

-continued
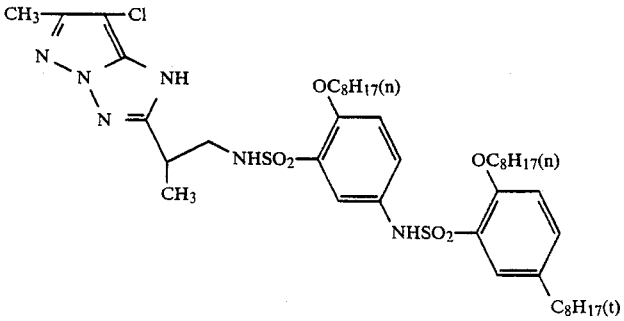
(ExYC-1) Yellow coupler
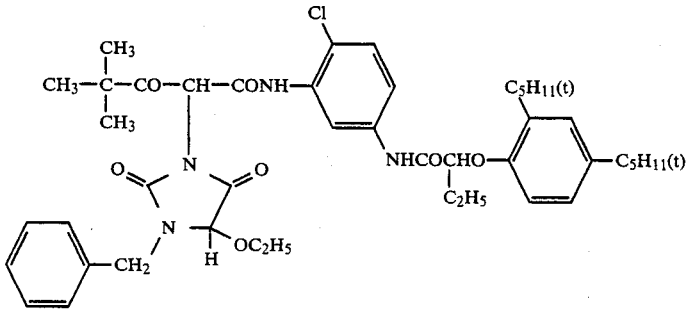
(ExSS-1) Spectral sensitizing dye
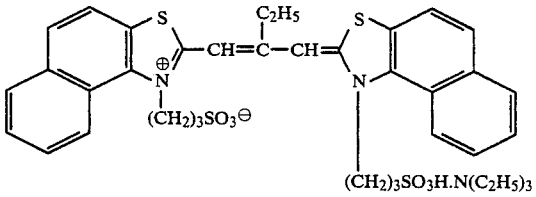
(ExSS-2) Spectral sensitizing dye
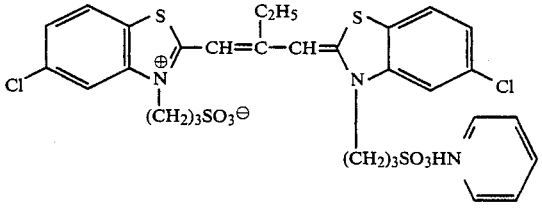
(ExSS-3) Spectral sensitizing dye
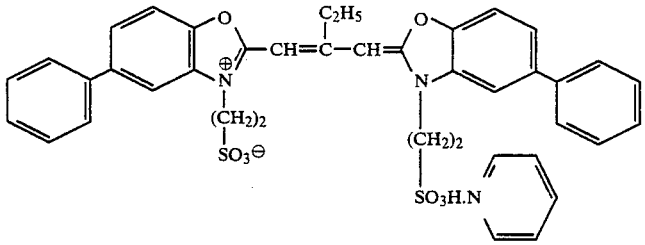
(ExSS-4) Spectral sensitizing dye
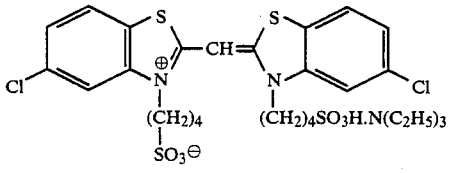

-continued (ExS-1) Solvent

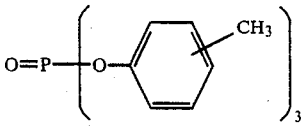

(ExS-2) Solvent

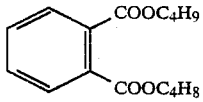

(ExS-3) Solvent

1/1 mixture (by volume) of

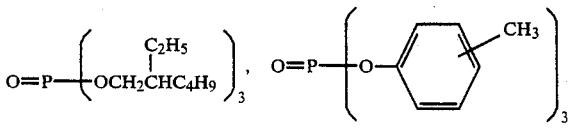

(ExS-4) Solvent $O{=}P{+}O{-}C_9H_{19}(iso))_3$ (ExUV-1) Ultraviolet light absorber Mixture of the compounds (1)/(2)/(3) of 5/9/8 by weight

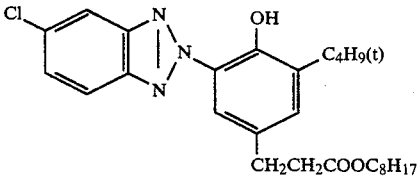

(1)

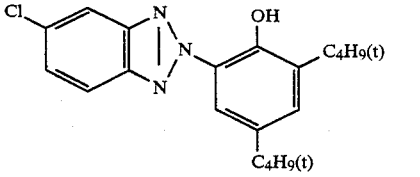

(2)

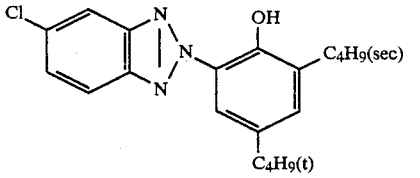

(3)

Mixture of the above compounds (1)/(2)/(3) of 2/9/8 by weight (ExSA-1) Dye image stabilizer

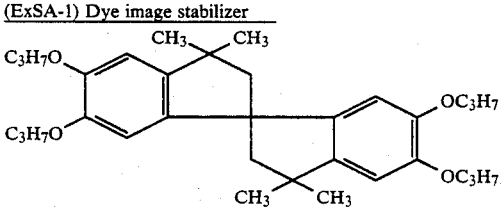

(ExKB-1) Color mixing inhibitor

-continued

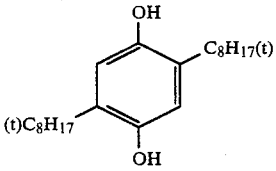

(ExGC-1) Development adjustor

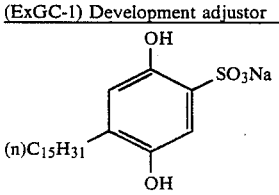

(ExA-1) Stabilizer

4- Hydroxy-5,6- trimethylene-1,3,3*a*,7-tetraazaindene (ExZS-1) Nucleating accelerator 2-(3-dimethylaminopropylthio)-5-mercaptro-1,3,4-thiadiazole hydrochloride (ExZK-1) Nucleating agent

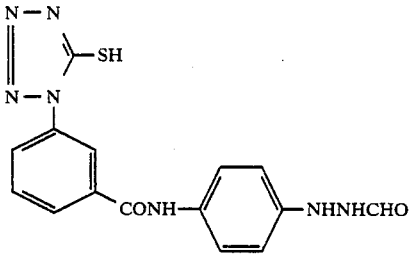

(ExGK-1) Gelatin hardener

Sodium salt of 1-oxy-3,5-dichloro-s-triazine

| Processing Stage A | Time | Temperature |
|---|---|---|
| Color development | 100" | 38° C. |

-continued

| | | |
|---|---|---|
| Bleach-fixing | 30" | 38° C. |
| Rinsing (1) | 30" | 38° C. |
| Rinsing (2) | 30" | 38° C. |

The replenishing system of rinsing water was such a countercurrent replenishing system that the rinsing bath (2) was replenished with rinsing water and an overflowed solution from the rinsing bath (2) was introduced into the rinsing bath (1).

| | Mother Liquor (Tank Solution) |
|---|---|
| Color Developing Solution | |
| Diethylenetriaminepentaacetic acid | 0.5 g |
| 1-Hydroxyethylidene-1,1-diphosphonic acid | 0.5 g |
| Diethylene glycol | 8.0 g |
| Benzyl alcohol | 10.0 g |
| Sodium bromide | 0.5 g |
| Sodium chloride | 0.7 g |
| Sodium sulfite | 2.0 g |
| N,N-Diethylhydroxylamine | 3.5 g |
| 3-Methyl-4-amino-N-ethyl-N-(β-methane-sulfonamidoethyl)-aniline | 6.0 g |
| Potassium carbonate | 30.0 g |
| Brightening agent (stilbene type) | 1.0 g |
| Pure water to make | 1000 ml |
| pH | 10.50 |
| pH was adjusted by adding potassium hydroxide or hydrochloric acid. | |
| Bleach-Fixing Solution | |
| Ammonium thiosulfate | 100 g |
| Sodium hydrogensulfite | 10 g |
| Ethylenediaminetetraacetic acid iron (III) ammonium dihydrate | 40 g |
| Disodium ethylenediaminetetraacetate dihydrate | 5 g |
| 2-Mercapto-1,3,4-triazole | 0.5 g |
| Pure water to make | 1000 ml |
| pH | 7.0 |
| pH was adjusted by adding ammonia water or hydrochloric acid. | |

Rinsing Water

Pure water was used.

Pure water used in the present invention was water obtained by treating tap water by means of an ion exchange treatment to reduce all cations other than hydrogen ion and all anions other than hydroxyl ion to 1 ppm or below.

The same procedure of the preparation of the sample No. A was repeated except that the compounds given in Table 4 were used in place of the nucleating agent (ExZK-1) to prepare multi-layer color photographic materials Nos. 1 to 4.

The thus-prepared samples were exposed through a wedge (1/10 second, 10 CMS) and then subjected to the processing stage A. The density of cyan color image was measured.

The results are shown in Table 4.

TABLE 4

| No. | Compound | Density of Cyan Image Dmax | Dmin |
|---|---|---|---|
| 1 (Invention) | I-1 | 2.0 | 0.11 |
| 2 (Invention) | I-5 | 2.0 | 0.11 |
| 3 (Invention) | I-11 | 2.4 | 0.11 |
| 4 (Invention) | I-12 | 2.5 | 0.11 |
| A (Comparison) | ExZK-1 | 1.4 | 0.12 |

The added amount of compound according to the present invention was equivalent to that of ExZK-1.

Samples No. 1 to 4 comprising the compound of the present invention exhibited higher maximum image densities ($D_{max}$) than Comparative sample No. A. As to magenta density and yellow density, similar results were obtained.

EXAMPLE 5

The surface of a transparent polyethylene terephthalate support was coated with the following layers in the following order to prepare photographic elements Nos. 1 to 6.

(1) A mordant layer containing gelatin (3.0 g/m$^2$) and a polymer (3.0 g/m$^2$) which is a copolymer described in U.S. Pat. No. 3,898,088 and is composed of the following repeating units in the following ratio.

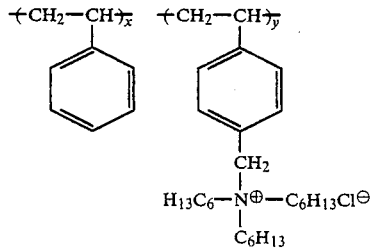

x/y = 50/50 (by mole)

(2) A white color reflecting layer containing titanium oxide (20 g/m$^2$) and gelatin (2.0 g/m$^2$).

(3) A light shielding layer containing carbon black (2.70 g/m$^2$) and gelatin (2.70 g/m$^2$).

(4) A layer containing the following magenta DRR compound (0.45 g/m$^2$), diethyllaurylamide (0.10 g/m$^2$), 2,5-di-t-butylhydroquinone (0.0074 g/m$^2$) and gelatin (0.76 g/m$^2$).

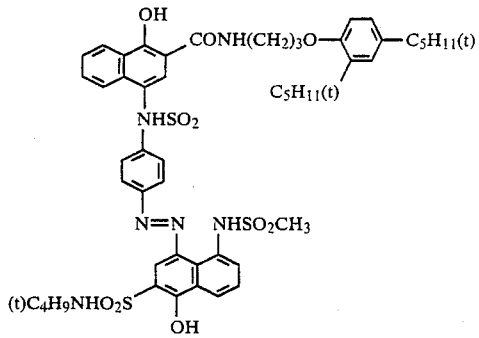

(5) A green-sensitive internal latent image type direct positive silver iodobromide emulsion (silver iodide content: 2 mol%) containing an internal latent image type emulsion (1.4 g/m$^2$ in terms of silver), a green sensitizing dye (1.9 mg/m$^2$), a nucleating agent given in Table 5 and sodium 5-pentadecyl-hydroquinone-2-sulfonate (0.11 g/m$^2$).

(6) A layer containing gelatin (0.94 g/m2).

The above photographic elements Nos. 1 to 6 in combination with each of the following elements were processed.

| Processing Solution | |
|---|---|
| 1-Phenyl-4-methyl-4-hydroxymethyl-3-pyrazolidine | 10 g |

-continued

| Processing Solution | |
|---|---|
| Methylhydroquinone | 0.18 g |
| 5-Methylbenztriazole | 4.0 g |
| Sodium sulfite (anhydrous) | 1.0 g |
| Carboxymethyl cellulose Na salt | 40.0 g |
| Carbon black | 150 g |
| Potassium hydroxide (28 wt % aqueous solution) | 200 ml |
| $H_2O$ | 550 ml |

Each of 0.8 g portions of the processing solution having the above composition was charged into a pressure rupturable container.

Cover Sheet

The surface of a polyethylene terephthalate support was coated with polyacrylic acid (10 wt. % aqueous solution, viscosity: 1000 cp, coating amount: 15 g/m$^2$) to form an acidic polymer layer (neutralizing layer). Further, the surface of the polymer layer of the support was coated with acetylcellulose in which 100 g of acetylcellulose is hydrolyzed to form 39.4 g of acetyl group, (coating amount: 3.8 g/m$^2$) as a neutralization timing layer and a copolymer (0.2 g/m$^2$) of styrene with maleic anhydride (molar ratio of styrene/ maleic anhydride about 60/40, molecular weight: about 50,000) to prepare a cover sheet.

Forced Deterioration Condition

Two sets of photographic elements Nos. 1 to 6 were prepared. One set was preserved in a refrigerator (5° C.). The other one set was allowed to stand at 35° C. and RH of 80% for 4 days.

Processing Stage

The cover sheet and the sensitive sheet were superposed each other. The color test chart was exposed from the side of the cover sheet. The above processing solution was spread between both sheets in such an amount as to give a thickness of 75 μm (spreading was conducted by the aid of press roller). Processing was carried out at 25° C. After a lapse of one hour from the completion of processing, the green density of image formed on an image-receiving layer was measured through the transparent support of the photosensitive sheet using Macbeth reflection densitometer. The results are shown in Table 5.

TABLE 5

| Photographic Element No. | Compound Kind | Compound Amount (mg/m$^2$) | $D^F$max | $S^F$ | $S^W$ |
|---|---|---|---|---|---|
| 1 (Comparison) | ExZK-1 | 0.1 | 1.70 | 100 | 100 |
| 2 (Comparison) | Comparative Compound D | 0.5 | 1.43 | could not be measured | |
| 3 (Invention) | I-9 | 0.1 | 1.80 | 95 | 101 |
| 4 (Invention) | I-10 | 0.1 | 1.83 | 101 | 102 |
| 5 (Invention) | I-11 | 0.1 | 1.80 | 100 | 101 |

TABLE 5-continued

| Photographic Element No. | Compound Kind | Compound Amount (mg/m$^2$) | $D^F$max | $S^F$ | $S^W$ |
|---|---|---|---|---|---|
| 6 (Invention) | I-12 | 0.1 | 1.85 | 101 | 103 |

Comparative Compound D

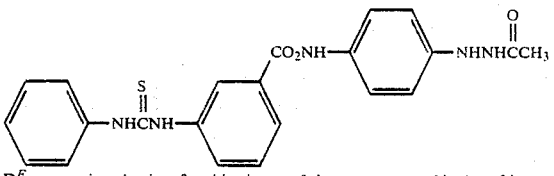

$D^F$max: maxium density of positive image of elements preserved in the refrigerator.
$S^F$: relative sensitivity ($S^F$ of photographic element 1 was referred to as 100) of density 0.5 of positive image of elements preserved in the refrigerator.
$S^W$: relative sensitivity ($S^F$ of sensitive element 1 was referred to as 100) of density 0.5 of positive image of samples when allowed to stand at 35° C. and RH of 80% for 4 days.

It is apparent from the above results that photographic elements 3 to 6 containing the nucleating agents of the present invention give $D_{max}$ values higher than that of conventional photographic element 1, though the nucleating agents are equal in amount, and that photographic sensitive elements 3 to 6 scarcely causes change in sensitivity as compared with comparative element 2, when the photographic materials are preserved.

EXAMPLE 6

The following emulsion X was prepared.

Emulsion X

An aqueous solution of silver nitrate and an aqueous solution of potassium bromide were simultaneously added to an aqueous gelatin solution (pH=5.5) containing 20 mg (per liter) of thioether (1,8-di-hydroxy-3,6-dithiaoctane) kept at 75° C. while vigorously stirring and keeping a silver electrode at a potential at which regular octahedral grain are grown at a constant speed, whereby silver nitrate in an amount corresponding to $\frac{1}{8}$ mol was added over a period of 5 minutes. Monodisperse emulsion obtained by spherical AgBr grains having a mean grain size of about 0.14 μm was obtained.

20 mg of sodium thiosulfate and 20 mg of chloroauric acid (tetrahydrate) were added to the emulsion, each amount being per mol of silver halide. The pH of the emulsion was adjusted to 7.5 and chemical sensitization was conducted at 75° C. for 80 minutes while vigorously stirring to obtain a core emulsion. Subsequently, an aqueous solution containing $\frac{7}{8}$ mol of silver nitrate and an aqueous solution of potassium bromide were simultaneously added thereto at that temperature over a period of 40 minutes while vigorously stirring and keeping the silver halide electrode at a potential at which regular octahedral grains are grown, whereby a shell was grown. A mono-disperse octahedral core/shell type emulsion having a mean grain size of about 0.3 μm was obtained. After the emulsion was washed with water, and desalted by ordinary method, and then dissolved by heating. The pH thereof was adjusted to 6.5. 5 mg of sodium thiosulfate and 5 mg of chloroauric acid (tetrahydrate) were added to the emulsion, each amount being per mol of silver halide. The emulsion was ripened at 75° C. for 60 minutes to carry out the chemical sensitization of the surface of shell, and then to obtain finally an internal latent image type monodisperse octahedral core/shell emulsion (emulsion X). The grain size distribution of the emulsion was measured from an electron microphotograph. It was found that mean grain size was 0.30 μm with a coefficient of variation (mean grain size × 100/standard deviation) of 10%.

5 mg (per mol of silver halide) of panchromatic sensitizing dye 3,3'-diethyl-9-methyl-thiocarbocyanine was added to the emulsion X. Each of the exemplified compounds (I-2), (I- 10), (I-12) and (I- 14) as the nucleating agents and ExZK-1 as comparative compound (i.e., as comparative nucleating agent), and $1\times10^{-3}$ mol (per mol of silver halide) of compound (a) as a nucleation accelerator, were added to the emulsion, the amounts of the compounds being given in Table 6. The surface of a polyethylene terephthalate was coated with the emulsion in such an amount as to give a coating amount of 2.8 g/m² in terms of silver. At the same time, a protective layer comprising gelatin and a hardening agent was coated thereon to prepare a direct positive photographic material which was sensitive up to red light.

Said photographic material was exposed through step wedge for 0.1 second using 1 kw tungsten lamp (color temperature: 2854° K) sensitometer.

The material was then developed at 38° C. for 18 seconds using Kodak Proster Plus developing solution (pH of developing solution being 10.7) and automatic processor (Kodak Proster I Processor). Subsequently, the developed material was rinsed, fixed and rinsed in the processor and then dried.

Maximum density ($D_{max}$), Minimum density ($D_{min}$) and relative sensitivity of the direct positive image of each of the thus-obtained samples were measured. The results are shown in Table 6.

TABLE 6

| Sample No. | Compound Kind | Compound Amount (mol/mol of AgX) | Positive $D_{max}$ | Positive $D_{min}$ | Relative Sensitivity (D = 1.2) |
|---|---|---|---|---|---|
| (Comparison) 1 | ExZK-1 | $1.0\times10^{-4}$ | 2.20 | 0.08 | 100 |
| (Invention) 2 | (I-2) | $1.0\times10^{-5}$ | 2.31 | 0.05 | 113 |
| | | $2.0\times10^{-5}$ | 2.34 | 0.06 | 105 |
| | | $3.0\times10^{-5}$ | 2.36 | 0.06 | 107 |
| (Invention) 3 | (I-10) | $1.0\times10^{-5}$ | 2.60 | 0.06 | 125 |
| | | $2.0\times10^{-5}$ | 2.70 | 0.06 | 109 |
| | | $3.0\times10^{-5}$ | 2.68 | 0.07 | 112 |
| (Invention) 4 | (I-12) | $1.0\times10^{-5}$ | 2.65 | 0.06 | 127 |
| | | $2.0\times10^{-5}$ | 2.75 | 0.06 | 110 |
| | | $3.0\times10^{-5}$ | 2.76 | 0.07 | 113 |
| (Invention) 5 | (I-14) | $1.0\times10^{-5}$ | 2.57 | 0.05 | 121 |
| | | $2.0\times10^{-5}$ | 2.65 | 0.06 | 108 |
| | | $3.0\times10^{-5}$ | 2.61 | 0.07 | 112 |

It is apparent from the results of Table 6 that the exemplified compounds (I-2), (I- 10), (I-12) and (I-14) are superior in the reversal characteristics to the nucleating agent ExZK-1 as control and has high sensitivity, though the amounts of the compounds to be added are as small as 1/10 of the amount of control ExZK-1. Therefore, it is clearly seen that novel nucleating agents of the present invention have very high nucleating activity.

The pH of the developing agent was adjusted to 10.0 by adding an acid. When these samples were developed in the same manner, it was found that samples using the compounds of the present invention exhibited similar excellent reversal characteristics.

ExZK-1

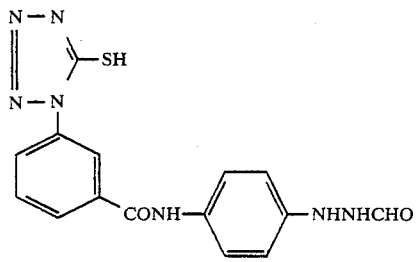

Compound (a)

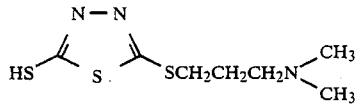

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one of silver halide photographic emulsion layers and other hydrophilic colloid layers, wherein at least one of said silver halide photographic emulsion layers and other hydrophilic colloid layers contains a compound represented by formula (I):

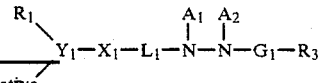

(I)

wherein at least one of $A_1$ and $A_2$ represent a hydrogen atom and the other represents a hydrogen atom, a sulfonyl group or an acyl group; $G_1$ represents a carbonyl group, a sulfonyl group, a sulfoxy group, a

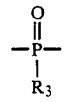

group, a

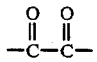

group, or an iminomethylene group; $L_1$ represents a bivalent group; $X_1$ represents —O—0 or an

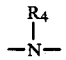

group wherein $R_4$ is hydrogen, an alkyl group or an aryl group; $Y_1$ represents

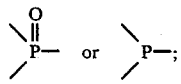

$R_1$ and $R_2$ each represents an aliphatic group, an aromatic group, a heterocyclic group, $—OR_5$ or $—NR_5R_6$ wherein $R_5$ is an aliphatic group, an aromatic group or a heterocyclic group, and $R_6$ is a hydrogen atom, an aliphatic group, an aromatic group or a heterocyclic group; and $R_3$ represents a hydrogen atom, an alkyl group, an aryl group, an alkoxy group, an aralkyl group, an aryloxy group, a hydrazino group or an amino group.

2. The silver halide photographic material as claimed in claim 1 wherein the compound represented by formula (I) is contained in the silver halide photographic emulsion layer.

3. The silver halide photographic material as claimed in claim 1 wherein the compound represented by formula (I) is contained in a hydrophilic colloid layer of the material.

4. The silver halide photographic material as claimed in claim 1 wherein both $A_1$ and $A_2$ are hydrogen atoms.

5. The silver halide photographic material as claimed in claim 1 wherein one of $A_1$ or $A_2$ is an alkylsulfonyl group, an arylsulfonyl group, an acyl group having not more than 20 carbon atoms, or a straight-chain, branched or cyclic, unsubstituted or substituted aliphatic acyl group.

6. The silver halide photographic material as claimed in claim 1, wherein at least one of $R_1$ and $R_2$ is a straight-chain, branched or cyclic alkyl, akenyl or alkinyl group.

7. The silver halide photographic material as claimed in claim 1, wherein at least one of $R_1$ and $R_2$ is an aromatic group selected from monocyclic or bicyclic aryl groups.

8. The silver halide photographic material as claimed in claim 1, wherein at least one of $R_1$ and $R_2$ is a heterocyclic group selected from three to ten membered heterocyclic rings containing at least one hetero atom of N, O and S.

9. The silver halide photographic material as claimed in claim 1, wherein $L_1$ is an atomic group containing at least one of C, N, S, and O.

10. The silver halide photographic material as claimed in claim 1, wherein $G_1$ is a carbonyl group.

11. The silver halide photographic material as in claim 1, wherein R3 is a hydrogen atom or a group represented by formula $$—L_2—Z_1 \qquad (a)$$

wherein $Z_1$ is a group suitable to nucleophilically attack $G_1$ to cleave the molecule and to release the moiety $G_1$-$L_2$-$Z_1$ from the molecule, and $L_2$ is a bivalent organic group suitable to nucleophilically attack $G_1$ to form a cyclic structure comprised of $G_1$, $L_2$ and $Z_1$.

12. The silver halide photographic material as claimed in claim 1, wherein $X_1$ is -NH-.

13. The silver halide photographic material as claimed in claim 1, wherein $Y_1$ is

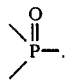

14. The silver halide photographic material as claimed in claim 11, wherein $Z_1$ is a group that when the following compound

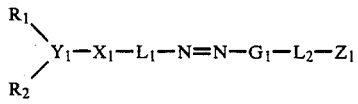

is formed by the oxidation of a hydrazine compound represented by formula (I), it nucleophilically attacks $G_1$ to release a group of

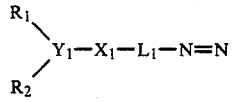

from $G_1$, selected from a functional group which can be directly reacted with $G_1$ or a functional group which can be reacted with $G_1$ by a reaction with a nucleophilic agent.

15. The silver halide photographic material as claimed in claim 1, wherein $R_1$ or $R_2$ is a nondiffusion.

16. The silver halide photographic material as claimed in claim 1, wherein $R_1$ or $R_2$ is a group having an adsorption accelerating group $Y_2$-$(L_3)_l$, in which $Y_2$ is an adsorption accelerating group on a surface of silver halide; $L_3$ is a divalent group; 1 is 0 or 1.

17. The silver halide photographic material as claimed in claim 1, wherein said compound represented by formula (I) is represented by formula (II):

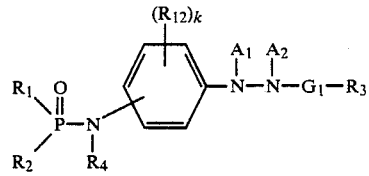

in which $R_{12}$ has the same meaning as in $R_1$ and $R_2$ of said formula (I); $R_1$, $R_2$, $R_3$, $R_4$, $A_1$, $A_2$, and $G_1$ have the same meaning as with respect to formula (I); a group having the formula

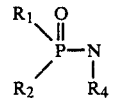

is substituted to the benzene ring at the O— P-position against hydrazine group.

* * * * *